US008540537B1

(12) United States Patent
Wong

(10) Patent No.: US 8,540,537 B1
(45) Date of Patent: Sep. 24, 2013

(54) ROWING RIG

(75) Inventor: Barnitus Alban Wong, Dearborn, MI (US)

(73) Assignee: Barnitus A. Wong, Detroit, MI (US)

( * ) Notice: Subject to any disclaimer, the term of this patent is extended or adjusted under 35 U.S.C. 154(b) by 259 days.

(21) Appl. No.: 13/149,385

(22) Filed: May 31, 2011

(51) Int. Cl.
*B63H 16/00* (2006.01)

(52) U.S. Cl.
USPC ..... 440/104

(58) Field of Classification Search
USPC ..... 440/101–110; 114/363, 364
See application file for complete search history.

(56) References Cited

U.S. PATENT DOCUMENTS

| | | | | |
|---|---|---|---|---|
| 588,455 | A | 8/1897 | Lofberg et al. | |
| 121,323 | A | 1/1917 | Morton | |
| 2,815,517 | A * | 12/1957 | Andresen, Jr. | 114/363 |
| 4,516,941 | A * | 5/1985 | Reid | 440/105 |
| 4,649,852 | A | 3/1987 | Piantedosi | |
| 6,095,878 | A | 8/2000 | Van Balen | |

OTHER PUBLICATIONS

Barnitus Wong, website www.pimpyourcanoe.com, photos with camouflage and blurring that prevents reverse engineering of art, Jun. 3, 2010, published in USA.
Barnitus Wong, website www.youtube.com, videos of art with camouflage and blurring that prevents reverse engineering, Jun. 3, 2010, published in USA.

* cited by examiner

*Primary Examiner* — Daniel Venne

(57) ABSTRACT

This embodiment relates generally to the Rowing Rig (30) for a suspended device (314), that may lead to the stabilization of a watercraft (32), such as kayaks and canoes, which allows an operator (316) to move and steer the watercraft (32) in a safe, ergonomic, and convenient manner. The rowing rig (30), with the example oarlock (40) adjustably connected to an outrigger (38), enables the support of and the counteraction of oaring forces imparted on oarlock (40), while allowing oarlock (40) to meaningfully adjustable in 3 independent axis relative to operator (316) location in watercraft (32). An inner guide system (52) can trap outrigger (38) in a secured position, or allow it to slidably travel within watercraft (32). The rowing rig (30) also allows the mounting of other systems, such as an anchor winch system, mounted to the base foundation (36) to counteract forces in deploying anchor. This allows full control of rowing, the steering, and stopping the watercraft (32) while operator (316) while sitting on rowing seat (34), by solo means.

20 Claims, 23 Drawing Sheets

ROWING RIG

CROSS REFERENCE TO RELATED APPLICATIONS (IF APPLICABLE)

This application claims the benefit of Provision Patent Application Ser. No. 67/241,139 filed on Sep. 10, 2009 by present inventor, which is incorporated by reference.

BACKGROUND

Prior Art for Rowing Rig

The following is a tabulation of some prior art that presently appears relevant:

| U.S. patents | | | |
|---|---|---|---|
| U.S. Pat. No. | Kind Code | Issue Date | Patentee |
| 588,455 | | Aug. 17, 1897 | Lofberg et al. |
| 1,213,233 | | Jan. 23, 1917 | Morton |
| 4,649,852 | | Mar. 17, 1987 | Piantedosi |
| 6,095,878 | | Aug. 1, 2000 | Van Balen |
| Non Patent Literature Documents | | | |
| None | | | |

Fishing from a paddled watercraft, such as a canoe or kayak, have become popular activities. Such fishing presents many benefits, especially in small, shallow water locations, where stealth and a shallow draft are almost prerequisites to successfully fish these conditions. The paddled watercraft, having a relatively narrow width, typically not much wider than to necessitate two people exchanging places in a canoe version, is a very maneuverable craft propelled and steered by a paddler in the aft position, and sometimes also including a paddler in the fore position. But paddling does not have the same ability to generate speed or to turn the paddled watercraft than if this watercraft was rowed instead. The rowing method is superior because an oar is often twice as long as a paddle, resulting in longer leverage. Additionally, you can row both sides at the same time, something not possible with paddling, resulting in doubling the propulsion work. Additionally, the oarlocks in rowing takes the stress when it opposes the rowing forces during a rowing stroke. This stress is then transmitted to the connecting gunwale of the watercraft for a rower. Aside from freeing up both hands to do propulsion work, rowing also reduces the stress on the rower than if he had to paddle instead. Additionally, rowing both sides of the watercraft simultaneously keeps the watercraft tracking in a straight line. This tracking would require a paddler to switch paddles sides frequently as one-sided paddling tracks the boat in a very wide circle, easily drifting it off course after a mere 3 or so one-sided strokes. This frequent changing of sides expends unnecessary energy that robs the energy that can be better directed for propulsion. Additionally, it introduces a gap time between propulsions on either side, causing the paddler to be not have steering and propulsion during such time. To make matters worst, oar drip from the raising of the oar over the watercraft when exchanging sides wets both the interior of the watercraft and the paddler; both are undesirable results especially in cold weather and when there are items in the watercraft to protect from dampness.

Rowing rigs outfitted with oarlocks, which fit inside a watercraft, is old and well known in the art. These devices are presently available to address the need to row a watercraft through the addition of such system of support members to resist the movement of oarlocks under rowing stress. In more recent times, these devices have been provided with clamping supports and allow such rig to be clamped to a paddled watercraft. The rigs generally have the oarlocks in a fixed extended position from the side of the craft, in a fixed up and down position, and in a fixed fore-aft position as well. Effectively, the oarlock position in space relative to the rig attachment is fixed. Several prior art have addressed this fixed position limitation by providing means to adjust the oarlock location, often only in the up and down location. Even so, these adjustments are limited to a modest range simply to fine tune efficiency. Most often, these prior art improvements simply address the ease of performing such adjustment, but which often require the watercraft to be moored to perform such adjustment as tools are often needed. A rower in the rowed watercraft, who wants to readily increase the propulsion work and maneuverability of such craft, has to moor his craft first, apply tools to perform the adjustment before using this rig system to achieve a greater efficient and a more comfortable way of controlling such vessel.

I have found that simply having an up and down adjustment is limiting in achieving rowing efficiency and comfort. Because no two people have the same build, rowers often require differing oarlock locations in order to achieve maximum rowing efficiency and comfort. Although this up and down adjustment allows the rower to adjust how high his hands are when he start and finishes a rowing stroke, this adjustment alone is not sufficient enough to optimize his efficiency and comfort. It does not allow him to adjust how far apart his hands are starting and ending for the row stroke. Additionally, this up and down adjustment does not allow him to adjust for different arm lengths, nor allows adjusting how far his hands are away from his body at the start, during, and the end of the row stroke. This lack of efficiency and comfort is even more so for fixed seat rowing, when the rower has less ability to adjust for this poor ergonomic setup. Additionally, this up and down adjustment does not allow him to optimize his oar leverage, a mechanical advantage that is defined by the oar pivot point between his row handle and the row blade. Additionally, this up and down adjustment does not allow him to better balance the oar so as to lighten its heavy feel for long lengths. This is especially true when the oar is long and requires a pivot point closer to the blade. This lightening is usually accomplishable by changing the oar pivot point. Additionally, this up and down adjustment does not allow using differing lengths of oar for differing water conditions. This is especially true when turbid current conditions require faster movement and quick turns accomplishable better with a longer oar, whereas tight sections of a river or calm water condition only require shorter oars.

Thus it is advantageous to have a rowing rig system that may allow the oarlocks to be adjusted in THREE (3) dimensions: up and down (Z axis), fore and aft (X axis), and in and out (Y axis).

Additionally, it is also advantageous to have this multi-axis adjustment performed quickly without having to moor the boat, i.e. an operation done on the fly (minimal downtime and while in the boat). This is particularly useful for switching between rowers of differing statures. Therefore, the ability to optimize the rowing setup for a differing stature will allow a quick trade between a first rower and a second rower without causing significant down time in travel.

Additionally, it would be advantageous for this multi-axis adjustment to be performed without the need for special or even any tools. This reduces the need to carry tools that simply add unnecessary weight to the craft load. Since there is no need for tools, this reduces the chance of losing tools that further complicates this adjustment.

In addition to speed, this adjustment should be simple, highly reproducible and repeatable in recalling prior oarlock locations. The obviousness of such adjustment would make it accessible even to the most unseasoned rower.

Due to the tight quarters and cramped nature of canoes, I have found that safety requires the rower to have full control of watercraft in a seated position, barring any need to move about. This means he can operate the canoe from his seat, giving him a cockpit like effect. Thus I have found that if I can attach an anchor winch system to this rowing rig, as well as a foot support to facilitate transmitting his rowing force more efficiently to his arms, the rowing operation is safer and uninterrupted in nature. Both the anchor winch and foot support system as also adjustable for the safety, efficiency, and comfort of the rower. This way, he is able to perform any watercraft related task with sufficient clearances, and yet find all the contraptions within easy, fast, and ergonomic reach.

Another problem I encountered is ensuring the rowing section of the canoe is stiff enough to handle the rowing, anchoring, and the foot support stress at the same time. Due to the lightweight, plastic nature, and low torsional stiffness of canoes, I have found most canoes do not resist stress well, especially when the canoe had not been designed for rowing long oars. Not only does the canoe require additional strengthening for rowing, but also even more strengthening is needed when both anchor winch and footrest systems are adding additional stress to this same area. Current clamp systems do not provide sufficient means of attaching such rig of multitasking nature to the canoe as the function behind such clamp system becomes quickly unusable when the canoe sidewall deforms under such multiple strain.

In FIG. 1, the adjustable oarlock in U.S. Pat. No. 588,455 issued to Lofberg et al, Aug. 17, 1897 only shows a lateral adjustment, absent of a Z-axis adjustment. Eventhough this art has at least a lateral adjustment, it forces the rower to accept that any lateral adjustment also causes an adjustment in the fore and aft (X-axis), barring any independence between both this and an Y-axis. Rather, this dependent nature makes fine tuning adjustments impossible.

In FIG. 2, the adjustable oarlock in U.S. Pat. No. 1,213,233 issued to Morton, Jan. 23, 1917, only shows an adjustment in the fore and aft direction (X-axis) and is thus lacking adjustment in the Z and Y-axis. Also, although the X axis adjustments is variable, i.e. the oarlock can be on any position between extreme ends, the ability to recall a prior location or detect if it is out of location is not present here. This is because the rower would have to rely on eye balling and relying on past memory, both processes that lack repeatability and reproducibility. Thus, the prior locations become as subjective as memory lacking strong cues, introducing a high degree of error. Thus, although this art was to provide maximum adjustability, it also created the downside of making the repeatability and reproducibility of prior locations imprecise.

In FIG. 3, the 'Rowing attachment for a canoe or the like art' in U.S. Pat. No. 4,649,852 issued to Piantedosi, Mar. 17, 1987, provides a means to slide a rower's seated position fore and aft from the oarlocks. The X axis adjustment mandates the use of the slider seat attached to the same structure as the oarlock. This mandate limits the use of this art in canoes that already having fixed seats, since the fixed seats preclude further longitudinal real estate for such art to fit in. Also, this art is lacking adjustment for the distance between oarlock and the fixed footrest, hence restricting the maximum comfort and efficiency for only rowers with only the suitable arm length to leg length ratio for this fixed setup. Additionally, the mandated use of the slider seat does not allow seat adjustment in the Z-axis, an important adjustment for canoe stability and oar shaft clearance to gunwale. This mandated use also stresses the gunwale and sides walls of a canoe, a stress path that was never designed in plastic canoes, introducing unexpected deformation. Additionally, this art provides adjustments in the Y-axis but lack adjustments in the Z-axis. As with the Morton art cited above, although this art provides maximum sliding adjustments in the fore and aft direction, it also created the downside of making the repeatability and reproducibility of prior locations imprecise.

In FIG. 4, the adjustable oarlock in U.S. Pat. No. 6,095,878 issued to Van Balen, Aug. 1, 2000, only addresses the oar lock adjustment in the Z-axis. The downside in this art is the same as the Morton and Piantedosi art whereby repeatability and reproducibility of prior oarlock settings is imprecise inspite of having the oarlock engaged in a threaded fashion in the Z axis. This art also mandates the additional use of a wrench to rotate an inner engaging member in order to raise or lower the oarlock, an operation that possibly requires the additional and time consuming act of mooring the boat. This art also lacks adjustment in the X and Y-axis.

ADVANTAGES

Accordingly several advantages of one or more aspects are as follows: the ability to adjust an oarlock in the X, Y, Z axis in an independent manner for varying rower builds, the ability to provide meaningful adjustment range within each axis, the ability to operate varying oar lengths ergonomically, the ability to perform such adjustments without any tools or high need for skill and training, the ability to perform such adjustment without incurring any time-consuming downtime such as mooring, the ability to recall prior locations in a highly reproducible and repeatable way, the ability to fit the art into a canoe of limited real estate from having fixed seats and to function with these fixed seat, the ability to have adjustable footrest independent of any oarlock adjustments, the ability to not deform a plastic canoe under rowing operation, the ability to incorporate additional systems that controls the safety and maneuverability of the canoe (such as an Anchor winch), and the ability to have these additional systems accessible and within ergonomic reach from a seated rowing position without impeding other functions such as rowing. Other advantages of one or more aspects will be apparent from a consideration of the drawings and ensuing description.

BACKGROUND

Discussion of Prior Art, Cross Reference to Related Application, and Advantages for Foot Rest The section for the foot rest is to be filed as part of a continuation to this application.

DRAWINGS

Figures

Notice:

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Figure 17A:
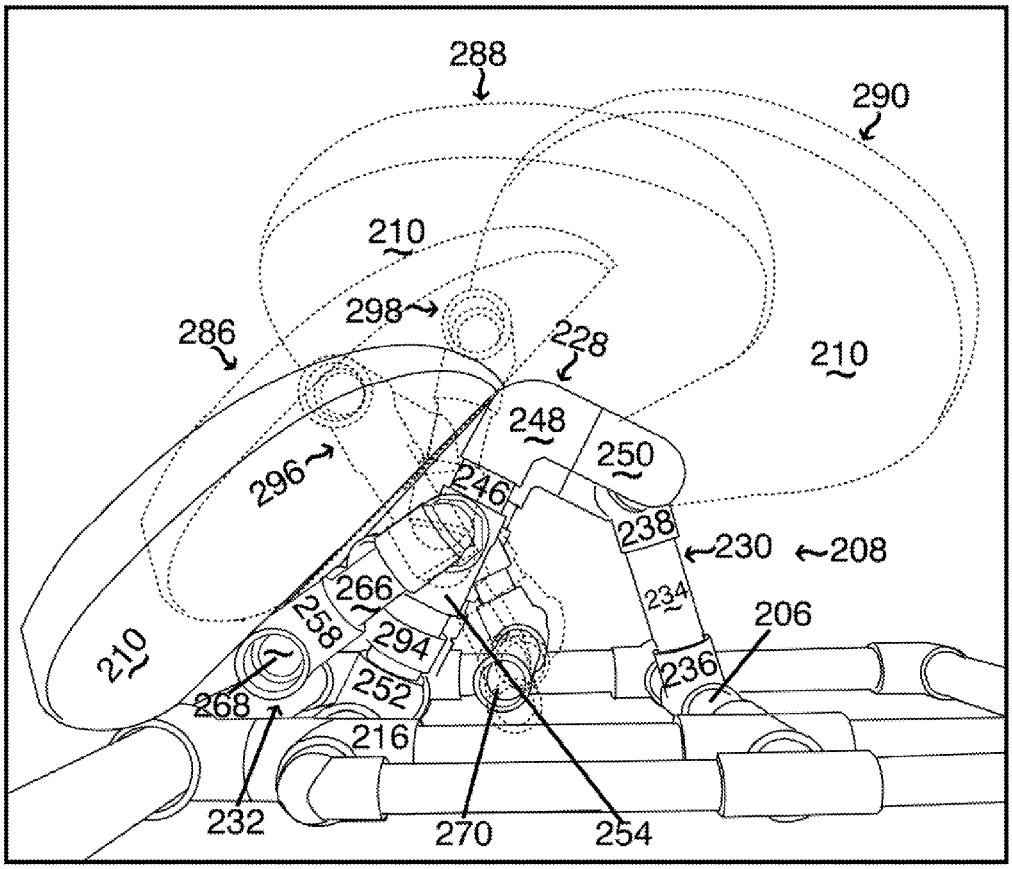
Figure 17B:
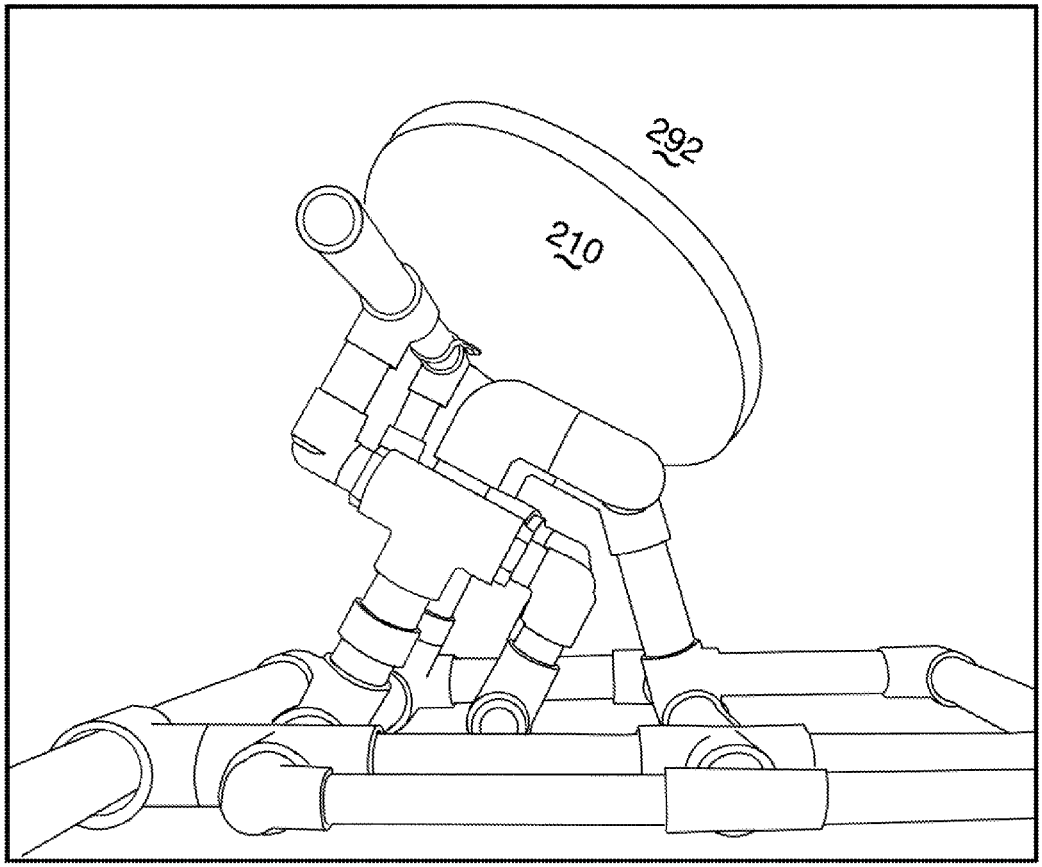

FIG. 17*a*. is a side view of Foot rest system with sequences of various foot board position FIG. 17*b*. is a side view of Foot rest system Reverse-Angle-but-Rearward position.

Figure 18:
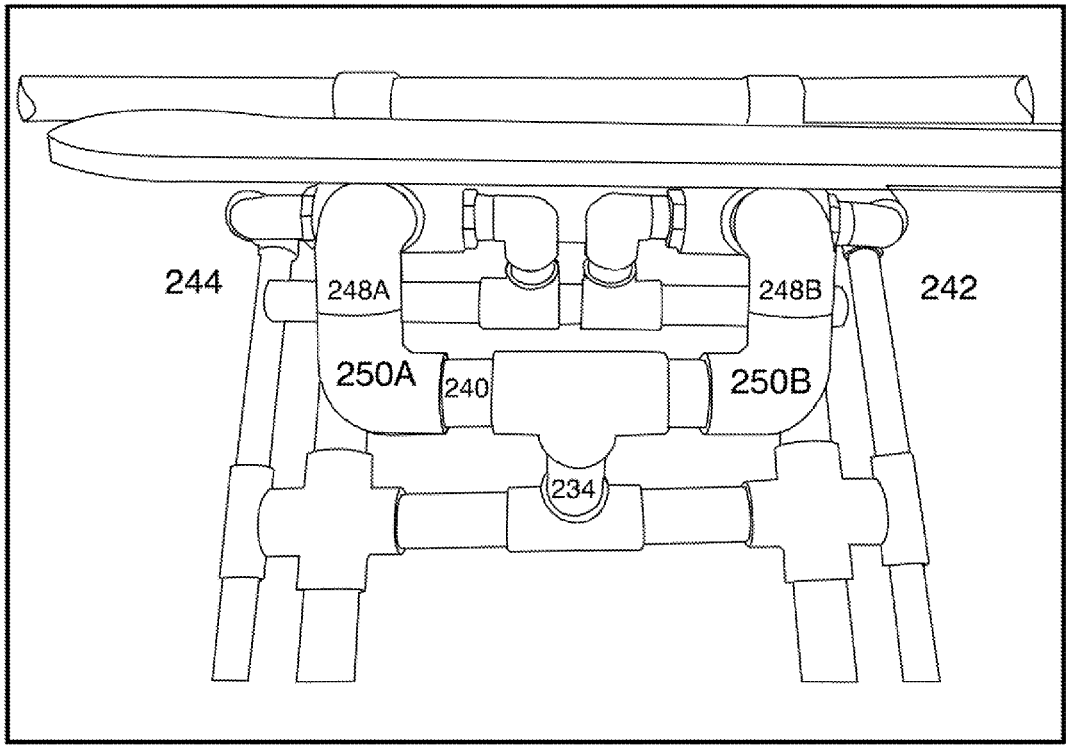

FIG. 18. is a top front view close-up of Foot rest system

Figure 19A:
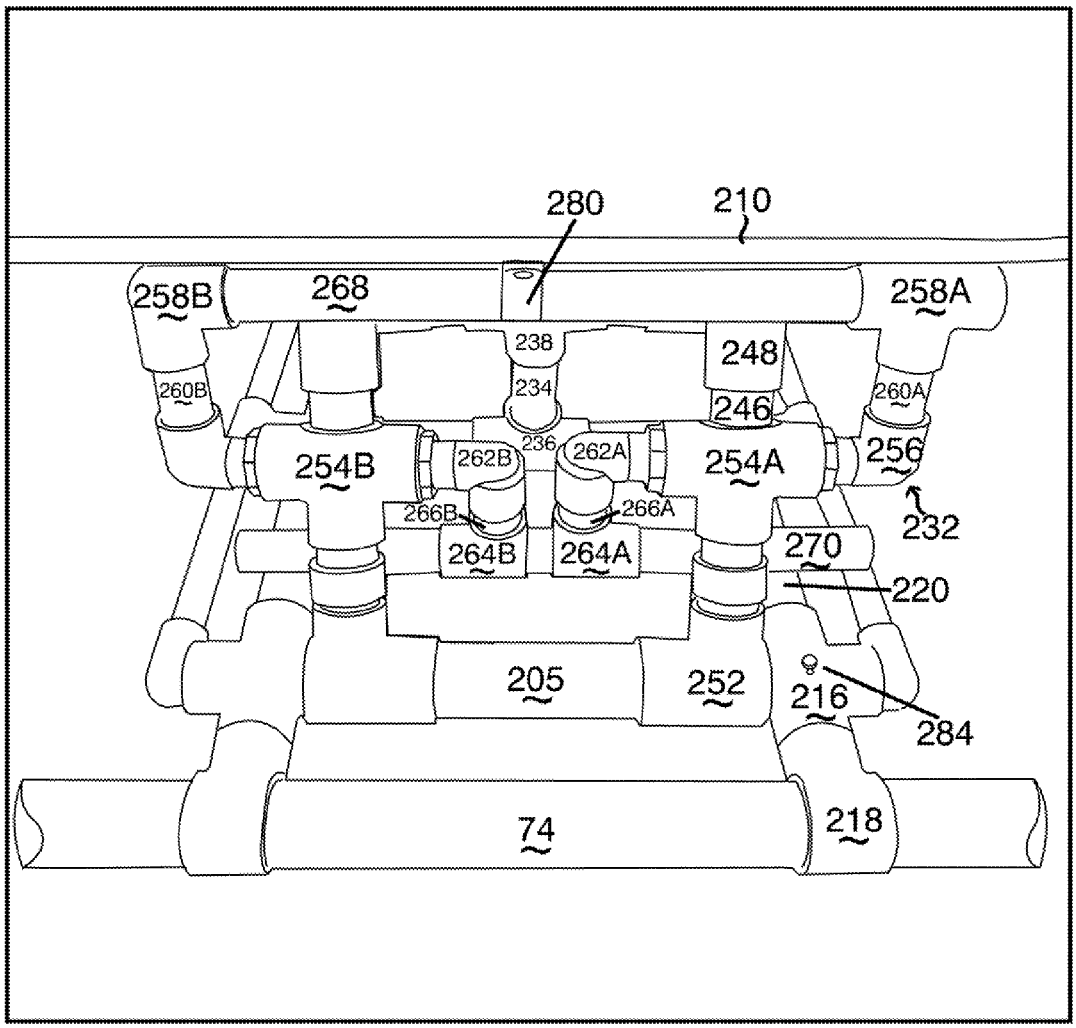

FIG. 19*a*. is a rear view of Foot rest system in position 290 for clarity.

Figure 19B:
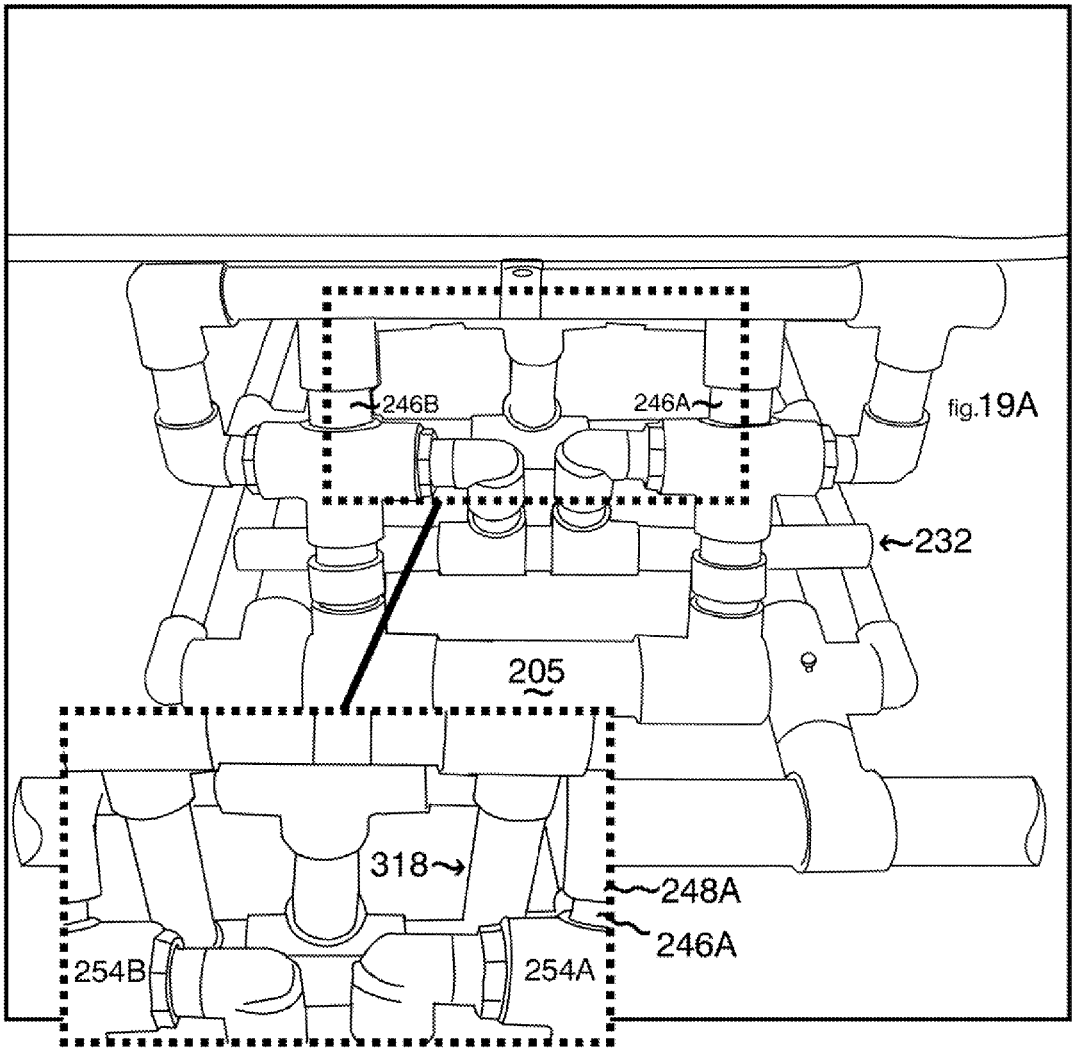

FIG. 19*b* is a rear view of Foot rest system in position 290 with the self centering feature in place.

Figure 20:
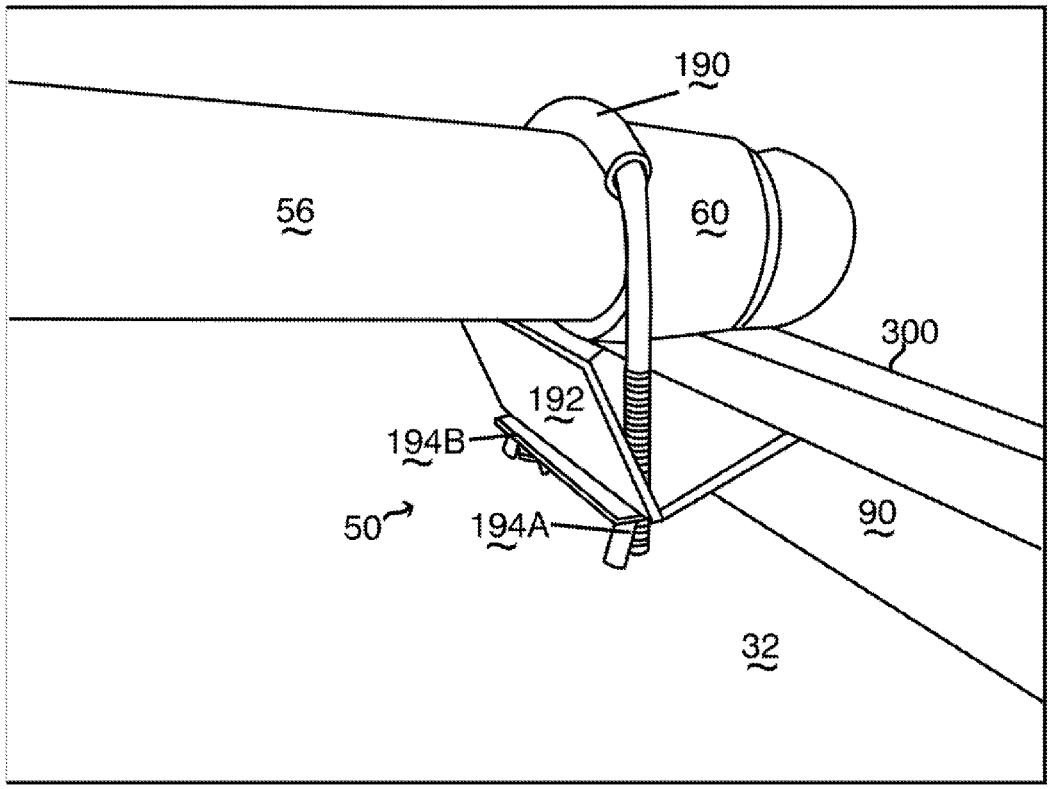

FIG. 20 is a view of attaching Rowing rig onto the gunwale

Alternate Embodiments

Figure 21:
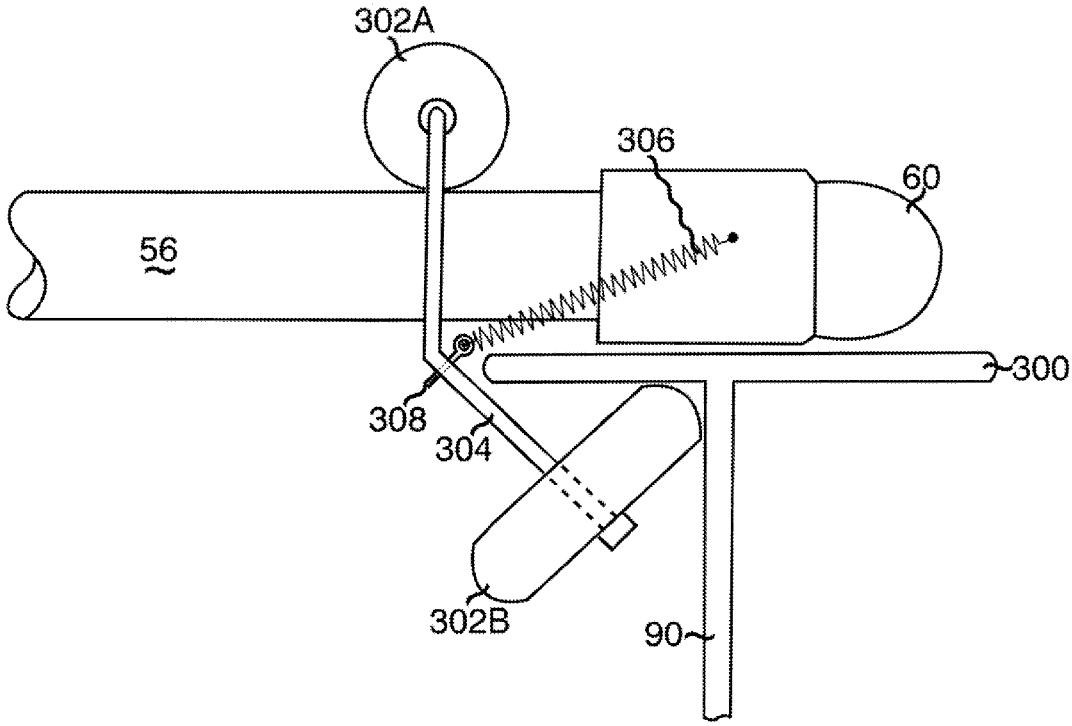
Figure 22:
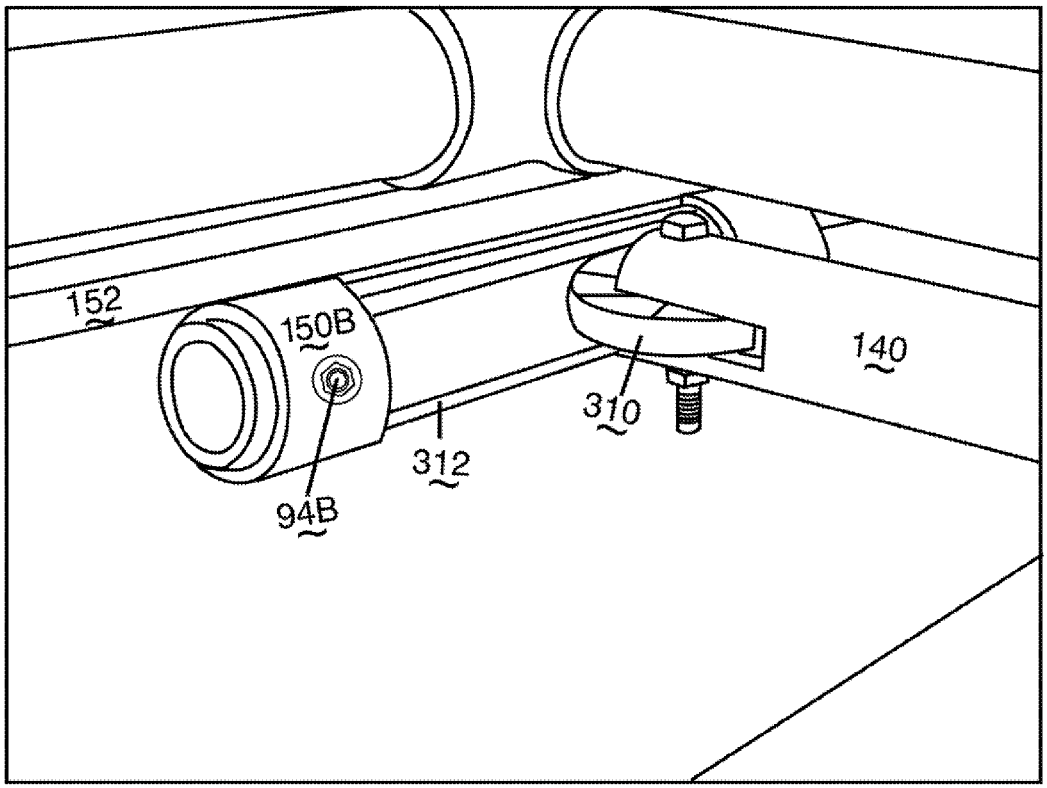
Figure 23:
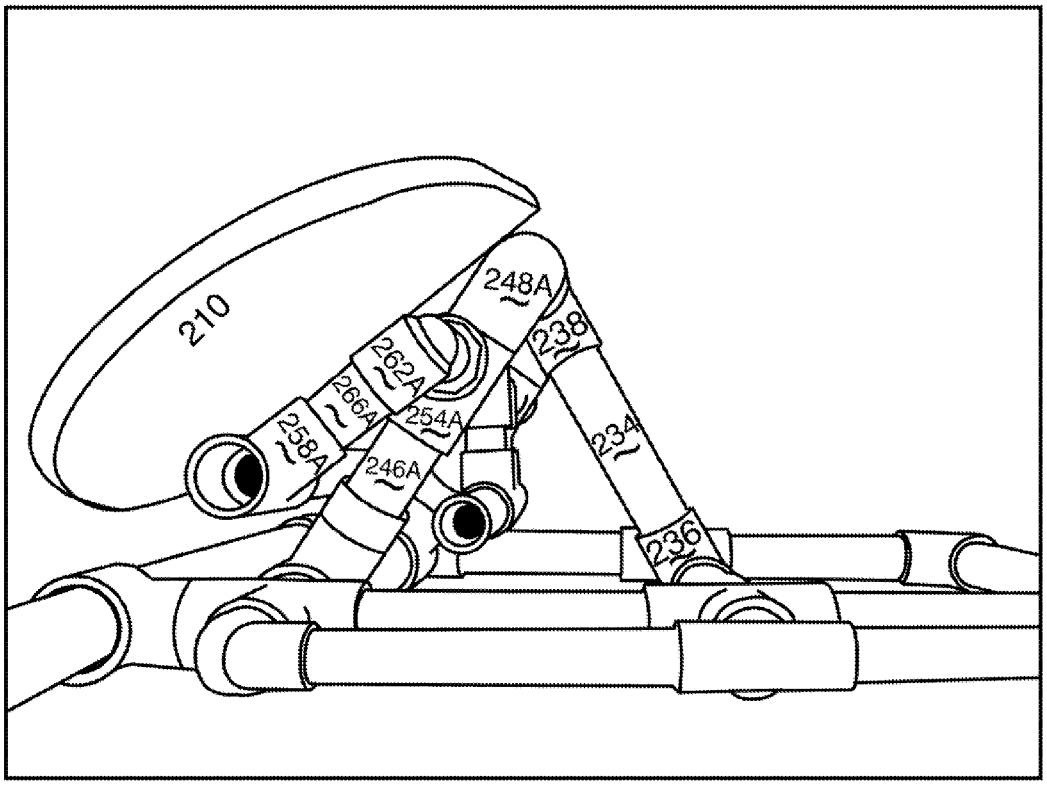

FIG. 21 is a view of attaching Rowing rig (via front base member 56) onto the gunwale 300 using a two wheel gunwale connection FIG. 22 is a view of an alternative connection that replaces fitting 84 and 146 with a yoke carrying a center bearing wheel riding at the bottom of a now C shape guides FIG. 23 is a view of Foot Rest Alternative embodiment to Bridge member 240 connection to BS first 90 degree fitting 248

Figure 24:
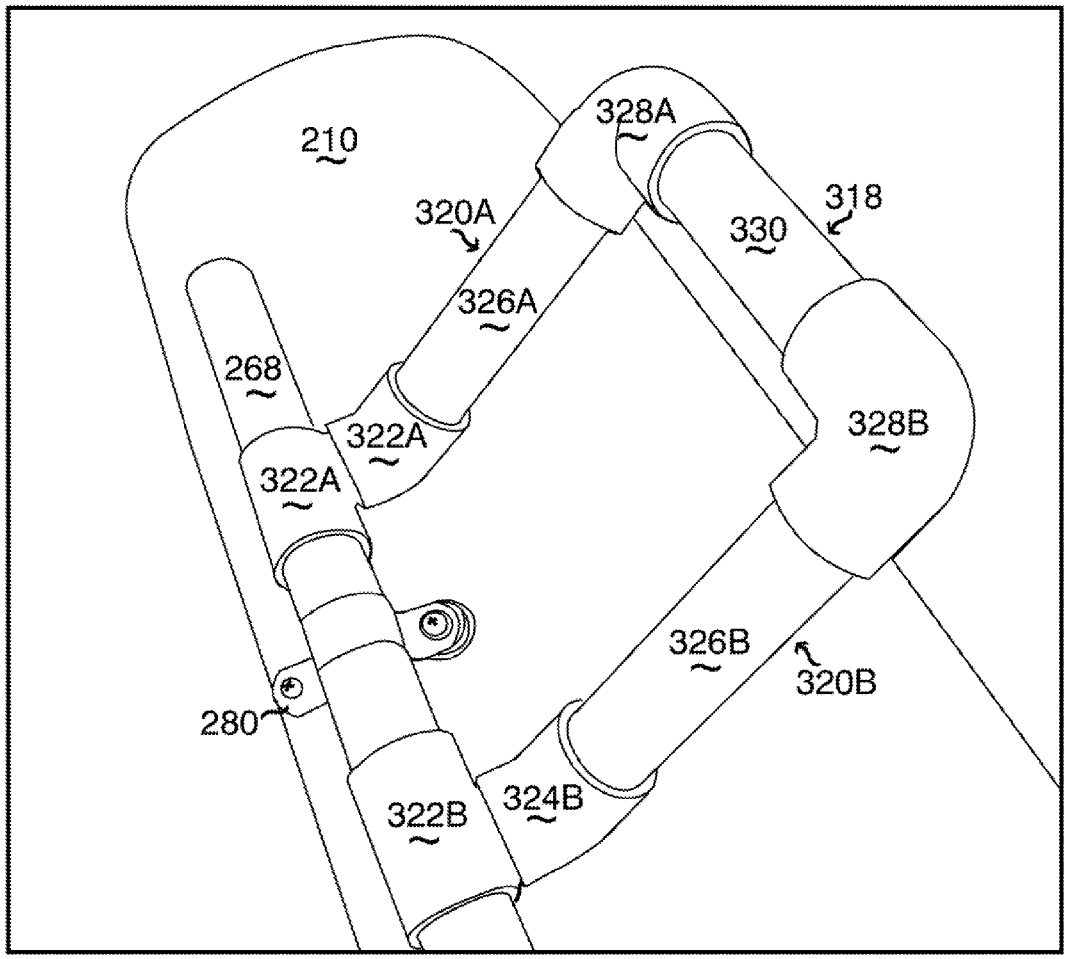

FIG. 24 shows self centering feature connected to foot board and first sliding member.

REFERENCE NUMERALS

| | |
|---|---|
| 30 Rowing Rig | 32 Watercraft |
| 34 Rowing seat | 36 Base foundation |
| 38 Outrigger | 40 Oarlock |
| 42 Anchor winch system | 44 Footrest system |
| 46 Left setup | 48 Right setup |
| 50 Gunwale connection | 52 Inner guide system |
| 54 Outer guide system | 56 Front base member |
| 58 Side Fore member | 60 Front 90 degree fitting |
| 62 Front threaded tee fitting | 64 Side aft member |
| 66 Side cross fitting | 68 Arm |
| 70 First rear 90 degree fitting | 72 Vertical member |
| 74 Rear base member | 76 Second rear 90 degree fitting |
| 78 Tee fitting | 80 Offset member |
| 82 Offset fitting | 84 Rail fitting |

-continued

| | |
|---|---|
| 86 Inner rail | 88 Inner Front (A) and Rear (B) stop |
| 90 Watercraft inside sidewall | 92 Front (A) and Rear (B) bolt |
| 94 Front (A) and Rear (B) nut | 96 Shims (A, B, C) |
| 98 Oarlock member | 100 Oarlock fitting |
| 102 Vertical leg | 104 Top adjustable arm system |
| 106 Bottom adjustable arm system | 108 Sliding base system |
| 110 End cap | 111 Vertical leg shims (A and B) |
| 112 Top arm tee fitting | 114 First 45 degree fitting |
| 116 Top inner arm | 118 Top outer arm |
| 120 First wirelock pin | 122 Threaded 45 degree fitting |
| 124 Bottom arm tee fitting | 126 Bottom inner arm |
| 128 Bottom outer arm | 130 Second wirelock pin |
| 132 Male threaded 90 degree fitting | 134 Female threaded 90 degree fitting. |
| 136 Top sliding cross fitting | 138 Bottom sliding cross fitting |
| 140 Bottom arm | 142 First end cap 90-degree fitting |
| 144 Second end cap 90-degree fitting | 146 Outer guide tee fitting |
| 148 Outer rail | 150 Front (A) and Rear (B) Outer stops |
| 152 Watercraft outside side wall | 154 Dual brace system |
| 156 Right (A) and Left (B) brace member | 158 Right (A) and Left (B) bottom tee fitting |
| 160 Right (A) and Left (B) second 45 degree tee fitting | 162 Right (A) and Left (B) top tee fitting |
| 164 Anchor winch | 166 Top bridge mount |
| 168 Bottom Bridge mount. | 170 Right (A) and Left (B) top bridge mount tee fitting |
| 172 Top center bridge 90-degree fitting | 174 First (A), Second (B), and Third (C) anchor bolt |
| 176 First (A), Second (B), and Third (C) anchor nut | 178 Right (A) and Left (B) bottom bridge mount tee fitting |
| 180 Right (A) and Left (B) Bottom center bridge 90-degree fitting | 182 Bottom stress carrying member |
| 184 Anchor fixing member | 186 Anchor fixing tee |
| 188 Third wire lock pin | 190 U bolt |
| 192 V housing | 194 Front (A) and Rear (B) Wingnut |
| Foot rest hereon: | |
| 200 Foot rest system | 202 FR Outside rail system |
| 204 Inside Rail system | 205 Static Cross Member |
| 206 FR moving cross member | 208 FR recline system |
| 210 Foot board | 212 FR outside rail member |
| 214 FR first 90 degree fitting | 216 FR first cross fitting |
| 218 FR Base fitting | 220 FR Side member |
| 222 FR Cross member 90 degree fitting | 224 FR second cross fitting |
| 226 Fr outside rail 90 degree fitting | 228 Board support system |
| 230 Bracing system | 232 Kick out system |
| 234 Bracing member | 236 First bracing fitting |
| 238 Second bracing fitting | 240 Bridge member |
| 242 Left side of board support system | 244 Right side board system |
| 246 Support member | 248 BS first 90 degree fitting |
| 250 BS second 90 degree fitting | 252 BS base fitting |
| 254 Right (A) and Left (B) KO Cross fitting | 256 KO first 90 degree fitting |
| 258 Right (A) and Left (B) Board tee fitting | 260 Right (A) and Left (B) First threaded member |
| 262 Anti tilt second 90 degree fitting | 264 Right (A) and Left (B) Anti tilt tee fitting |
| 266 Right (A) and Left (B) second threaded member | 268 First sliding member |
| 270 Second sliding member | 280 'C' shape attachment strap |
| 282 FR first wirelock pin | 284 FR second wirelock pin |
| 286 Raised but angled position | 288 Flat position |
| 290 Reverse angle but forward position | 292 Reverse angle but rearward position |
| 294 Second set of shims | 296 First swing out position |
| 298 Second swing out position | 300 Gunwale |
| 302 Top (A) and Bottom (B) wheel | 304 Housing |
| 306 Spring | 308 Eyebolt |
| 310 Center bearing wheel and Yoke | 312 C shape guides |
| 314 Suspended device | 316 Operator |
| 318 Self centering feature | 320 Right (A) and Left (B) armature |
| 322 Right (A) and Left (B) SC tee fitting | 324 Right (A) and Left (B) SC 45 degree fitting |

-continued

| | |
|---|---|
| 326 Right (A) and Left (B) SC side leg | 328 Right (A) and Left (B) SC 90 degree fitting |
| 330 SC bridge | 332 Right (A) and Left (B) SC Bolts |
| 334 Right (A) and Left (B) SC nuts | |

SUMMARY

Embodiments

Embodiments of the approaches described herein provide an apparatus comprising: a suspended device configured to connect to a vertical leg, the vertical leg having a first vertical end and a second vertical end, the vertical leg being configured to extend in a vertical direction, the suspended device being configured to slide along the vertical leg and to removably attach to the vertical leg in at least a first position or a second position, the second position being at a different distance from the first vertical end of the vertical leg than the first position; a first horizontal arm having a first horizontal end and a second horizontal end, the first horizontal arm configured to extend in a first horizontal direction, the vertical leg being configured to slide along the first horizontal arm and to removably attach to the first horizontal arm in at least a third position and fourth position, the third position being at a different distance from the first horizontal end than the fourth position; and a vehicle connection member configured to connect to the first horizontal arm or the vertical leg, the vehicle connection member being further configured to connect to a first side of a vehicle, to translate along the first side of the vehicle, and to removably attach to the first side of the vehicle in at least a fifth position or a sixth position.

Optionally, the vehicle is a watercraft and the suspended device is an oarlock.

Optionally, an additional system is configured to connect to the vehicle connection member, the additional system applying an additional force to the vehicle connection member.

Optionally, the suspended device is configured to removably attach to the vertical leg in at least one of the first position or the second position via at least one removable shim.

Optionally, the suspended device is connected to the vertical leg via a connecting member.

Optionally, the vehicle connection member is configured to removably attach to the first side of the vehicle in at least one of a fifth position or a sixth position via at least one removable shim.

Optionally, the at least one removable shim is configured to be adjusted by an operator of the vehicle while the vehicle is being operated.

Optionally, the vehicle connection member is configured to slide or roll along the first side of the vehicle.

Optionally, the first side of the vehicle extends in a second horizontal direction, the second horizontal direction being normal to the first horizontal direction.

Optionally, the position of the suspended device is adjustable in at least the vertical direction and at least one horizontal direction.

Optionally, the apparatus further includes a second horizontal arm configured to lie parallel to the first horizontal arm and configured to connect to the vertical leg.

Optionally, the second horizontal arm is configured to direct a stress in the vertical direction or in at least one horizontal direction from the suspended device to the vehicle.

Optionally, the apparatus further includes at least one side arm configured to lie parallel to the first side of the vehicle, the at least one side arm being configured to connect to at least one of the first horizontal arm or the second horizontal arm.

Optionally, the at least one side arm is configured to direct a stress in at least one horizontal direction from the suspended device to the vehicle.

Optionally, the vehicle connection member is configured to connect to the first side of vehicle in a location proximate to a seat for an operator of the vehicle.

Optionally, the location proximate to the seat for the operator of the vehicle is configured to be selected by the operator of the vehicle.

Embodiments of the approaches described herein provide an apparatus comprising: an suspended device connected to a vertical leg, the vertical leg having a first vertical end and a second vertical end, the vertical leg extending in a vertical direction, the suspended device being configured to slide along the vertical leg and to removably attach to the vertical leg in at least a first position or a second position, the second position being at a different distance from the first vertical end of the vertical leg than the first position; a first horizontal arm having a first horizontal end and a second horizontal end, the first horizontal arm extending in a first horizontal direction, the vertical leg being configured to slide along the first horizontal arm and to removably attach to the first horizontal arm in at least a third position and fourth position, the third position being at a different distance from the first horizontal end than the fourth position; and an vehicle connection member connected to the first horizontal arm or the vertical leg, the vehicle connection member being further configured to connect to a first side of a vehicle, to translate along the first side of the vehicle, and to removably attach to the first side of the vehicle in at least a fifth position or a sixth position.

Optionally, the vehicle connection member is connected to the first side of the vehicle.

Optionally, the vehicle connection member is configured not to deform the vehicle as a result of the vehicle connection member being connected to the first side of the vehicle.

Embodiments of the approaches described herein provide a watercraft comprising: a first apparatus at a left side of the watercraft, the first apparatus comprising: a left suspended device connected to a left vertical leg, the left vertical leg having a first left vertical end and a second left vertical end, the left vertical leg extending in a vertical direction, the left suspended device being configured to slide along the left vertical leg and to removably attach to the left vertical leg in at least a first left position or a second left position, the second left position being at a different distance from the first left vertical end of the left vertical leg than the first left position, a first left horizontal arm having a first left horizontal end and a second left horizontal end, the first left horizontal arm extending in a first horizontal direction, the left vertical leg being configured to slide along the first left horizontal arm and to removably attach to the first left horizontal arm in at least a third left position and fourth left position, the third left position being at a different distance from the first left horizontal end than the fourth left position, and a left vehicle connection member connected to the first left horizontal arm or the left vertical leg, the left vehicle connection member being connected to the left side of the watercraft, the left vehicle connection member being configured to translate along the left side of the watercraft, and to removably attach to the left side of the watercraft in at least a fifth left position or a sixth left position; and a second apparatus at a right side of the watercraft, the second apparatus comprising: a right suspended device connected to a right vertical leg, the right vertical leg having a first right vertical end and a second right vertical end, the right vertical leg extending in the vertical direction, the right suspended device being configured to slide along the right vertical leg and to removably attach to the right vertical leg in at least a first right position or a second right position, the second right position being at a different distance from the first right vertical end of the right vertical leg than the first right position, a first right horizontal arm having a first right horizontal end and a second right horizontal end, the first right horizontal arm extending in the first horizontal direction, the right vertical leg being configured to slide along the first right horizontal arm and to removably attach to the first right horizontal arm in at least a third right position and fourth right position, the third right position being at a different distance from the first right horizontal end than the fourth right position, and a right vehicle connection member connected to the first right horizontal arm or the right vertical leg, the right vehicle connection member being connected to the right side of the watercraft, the right vehicle connection member being configured to translate along the right side of the watercraft, and to removably attach to the right side of the watercraft in at least a fifth right position or a sixth right position.

DETAILED DESCRIPTION

First Embodiment

FIGS. 5 to 14

This right side teaching is repeated for the left side of the figures, and vice versa, as the embodiment is symmetrically identical on both sides where applicable. Whenever there is no distinguishment between a right side part and an identical left side part, it is assumed the right side for left side teaching and vice versa is still preserved.

With reference to the drawings FIGS. 5 to 14, a Rowing rig 30 mounted to a watercraft 32 is illustrated. Aft of the rowing rig 30 is a Rowing seat 34 that is part of, or affixed to, the watercraft 32. The rowing rig 30 comprises mainly of a base foundation 36, an outrigger 38 affixed at one end of base foundation 36, and an oarlock 40 affixed to the outrigger 38. Also affixed to the base foundation 36 are an Anchor winch system 42, and a Footrest system 44. Shown here is an example setup where two oarlocks 40 are required, where outrigger 38 on a left setup 46 is reflected across to the opposite side, right setup 48. A one-oarlock setup only requires a single oarlock setup, i.e. left setup 46 or right setup 48. The preference for the location of rowing rig 30 is within the adjustability range of contemplated rowers of wide varying physical builds to row ergonomically when seated at rowing seat 34, also known as a proximate location. Also, this location preferably coincides with about the center of the watercraft 32 so as to not only provide ample room for other occupants but more importantly the center allows faster turning maneuvers when rowing. Rowing rig 30 is mounted to the watercraft 32 by a gunwale connection 50, by an inner guide system 52, and by an outer guide system 54, both that will be detailed below. The outer guide system 54 does not significantly add to the mounting, but simply acts as a means to counteract the downward forces imparted on outrigger 38 during rowing and while under the weight of oars (not shown and not part of art).

I presently contemplate in all embodiments the foregoing joints, members, and pivot or moving joints to be made out of Schedule 40 PVC piping and fittings in several classes of diameters. However, they can have several different cross sections, such as oval, triangular, circular, etc., different sizes, different thickness and different materials, such as high carbon steel, aluminum and it's alloys, titanium, polycarbonate, etc.

Figure 1:
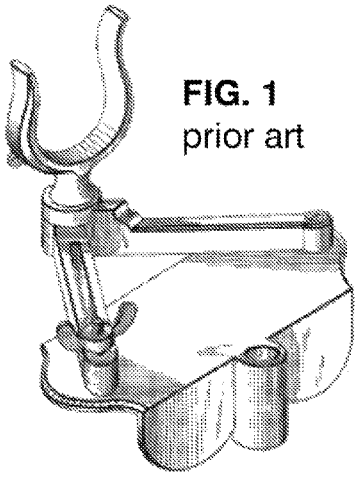
FIG. 1 prior art
FIG. 1 is Prior Art, Lofberg et al's embodiment.
Figure 2:
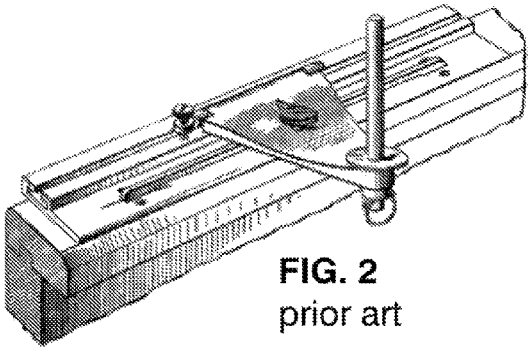
FIG. 2 prior art
FIG. 2 is Prior Art, Morton's embodiments.
Figure 3:
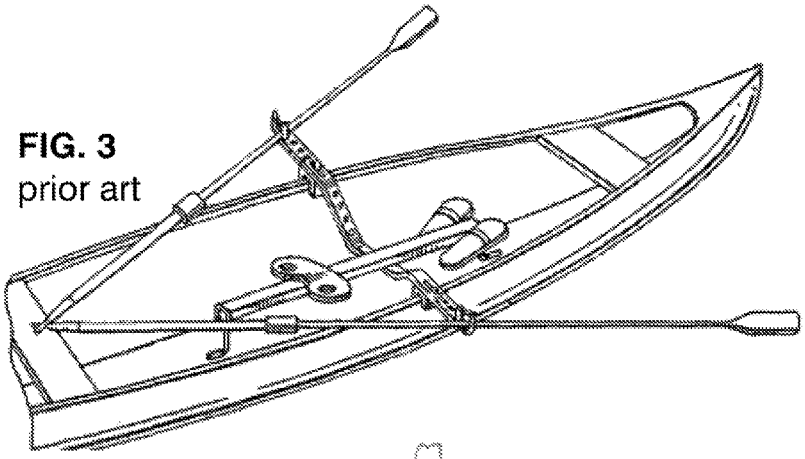
FIG. 3 prior art
FIG. 3 is Prior Art, Piantedosi's embodiments.
Figure 4:
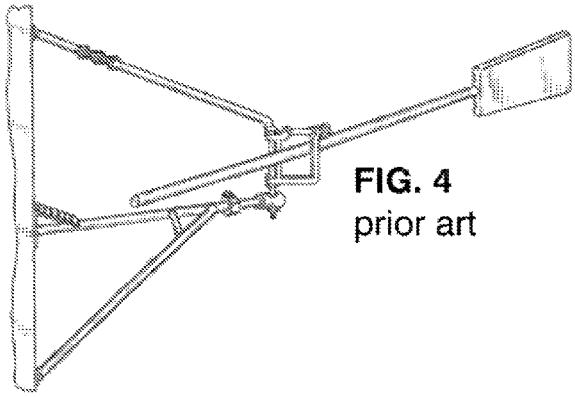
FIG. 4 prior art
FIG. 4 is Prior Art, Van Balen's embodiments.
Figure 5:
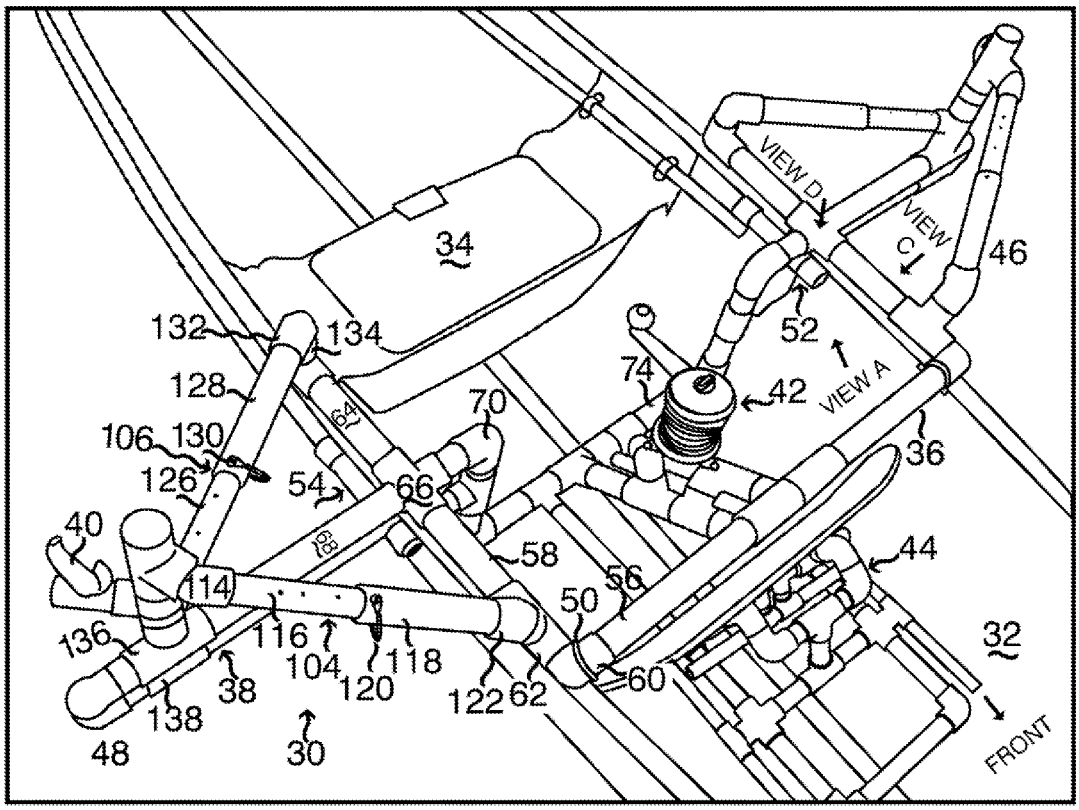
FIG. 5 is a Front isometric view of the embodiment in a watercraft

With reference to FIG. 5, the base foundation 36 comprises of a front base member 56 with a side fore member 58 connected to thereof by a front 90 degree fitting 60 and front threaded tee fitting 62. A side aft member 64 is connected to side fore member 58 by a side cross fitting 66. Arm 68 slidably connects through the side cross fitting 66 and into first rear 90-degree fitting 70.

Figure 6:
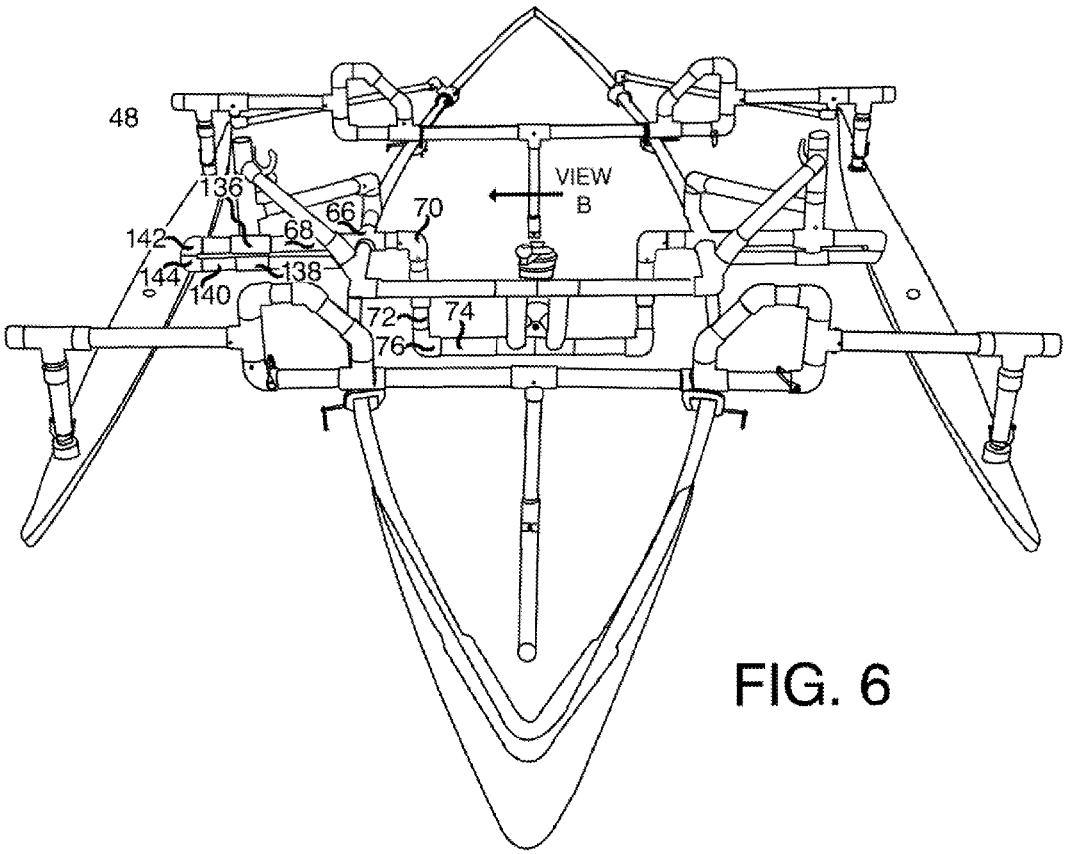
FIG. 6 is a front view of the Rowing Rig, with current art shown working with outriggers (art filed in Sep. 2010).

With reference to FIG. 6, a vertical member 72 connects to first rear fitting 70, and a rear base member 74 is connected to the vertical member 72 by a second rear 90 degree fitting 76.

Figure 7:
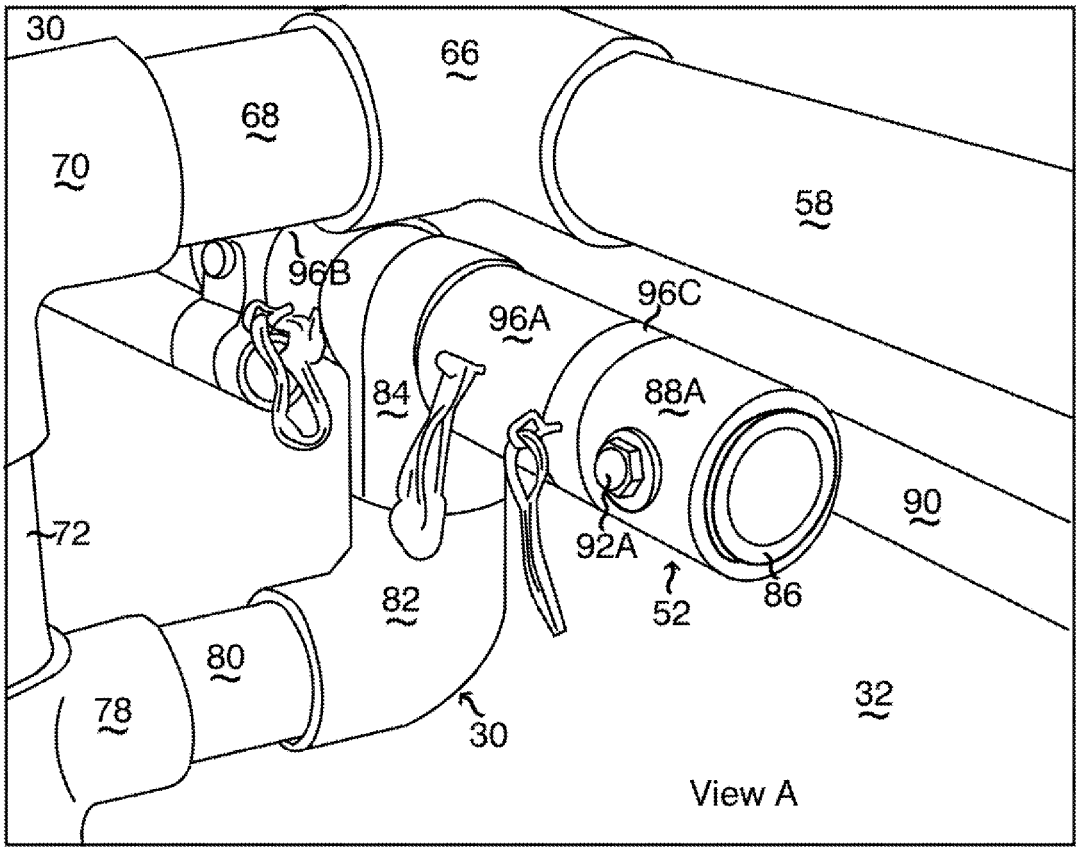
FIG. 7 is a close-up of View A callout in FIG. 5

With reference to FIG. 7, inner guide 52 system adjustably connects rowing rig 30 to watercraft 32. Inner guide 52 is connected to rowing rig 30 with tee fitting 78 slidably connected to vertical member 72 on one end, and connected to offset member 80 which connects to inner guide 52 on the other end.

The inner guide system 52 comprises of an offset fitting 82 that connects to rail fitting 84 that slidably engages with inner rail 86. A inner front stop 88A slidably engages over rail 86, providing sufficient clearance for rail fitting 84 to travel freely over inner rail 86 without watercraft inside sidewall 90 rubbing or interfering with this travel.

Figure 10:
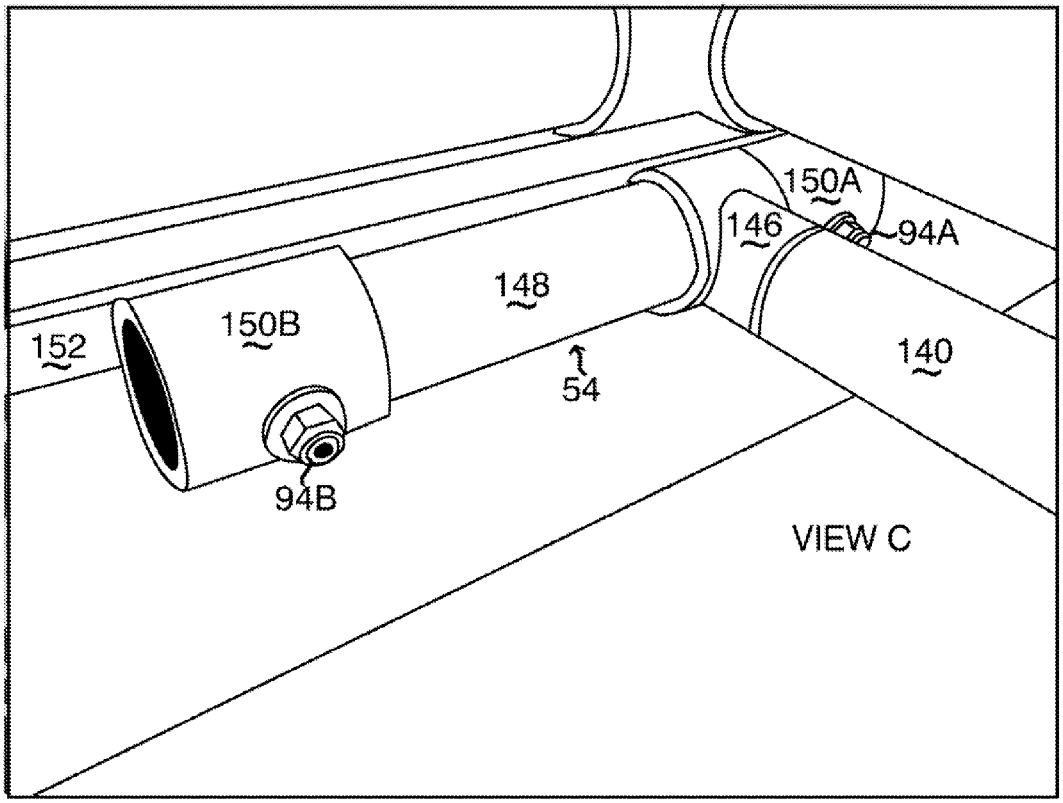
FIG. 10 is a isometric view of the Outer guide, view C in FIG. 5.

A front bolt 92A passes through holes defined by inner front stop 88A, inner rail 86, and watercraft inside sidewall 90, and is fastened down with front nut 94A (shown in FIG. 10). The same attachment arrangement is repeated at the opposite end of rail 86 with first rear stop 88B, rear bolt 92B, and rear nut 94B (shown in FIG. 11).

Figure 8:
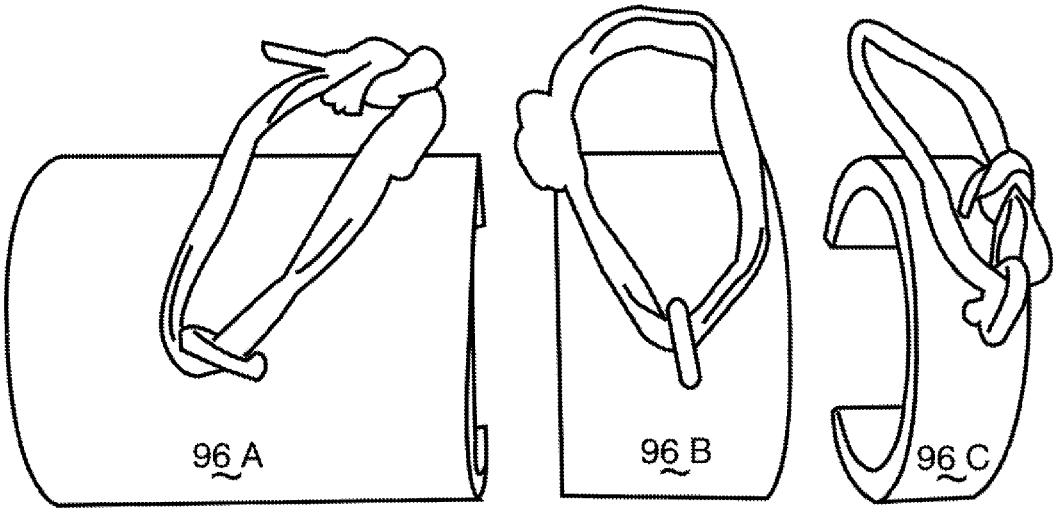
FIG. 8 is a front view of Shims of varying lengths

With additional reference to FIG. 8, 'C' shaped shims 96A, 96B, 96C are snapped onto inner rail 86 either aft or rear of rail fitting 84 in a combination that traps rowing rig 30 from moving fore and aft from watercraft 32 during rowing. When these shims are of varying widths, they can be matched to provide a trapping of rowing rig 30 in the fore and aft direction as precise as every half-inch. The current embodiment contemplates the shims 96A, 96B, 96C to be 2", 1", and ½" in width respectively.

Figure 9:
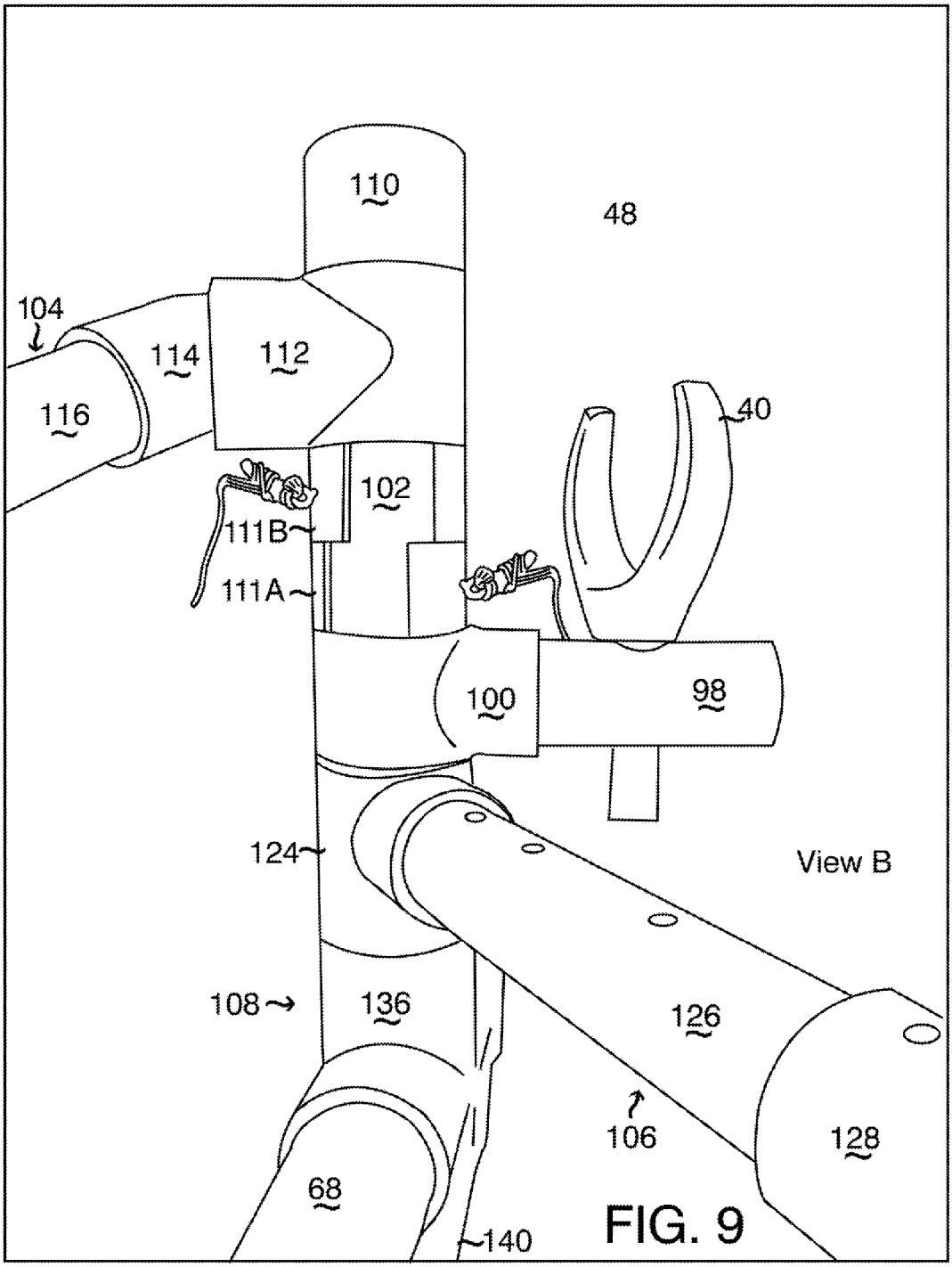
FIG. 9 is a close up view of Oar lock supports, view B in FIG. 6

With reference to FIG. 5, oarlock 40 is connected to rowing rig 30 by outrigger 38. With reference to FIG. 9, the oarlock is connected to an oarlock member 98 that is connected to oarlock fitting 100. The oarlock fitting 100 slidably engages with Vertical Leg 102, allowing the fitting to slide up and down the leg. The vertical leg is constrained to resist any movement during rowing stress at THREE (3) connection points: a) Top Adjustable arm system 104, b) Bottom Adjustable arm system 106, and c) Sliding Base system 108. The vertical leg 102 is connected to sliding base system 108, and both top adjustable arm system 104 and bottom adjustable arm system 106 are rotatably connected to the vertical leg 102. Oarlock 40 is trapped to remain in place along vertical leg 102 by adding end cap 110, and vertical leg shims 111A and B.

With reference to FIG. 9, Top adjustable arm system 104 comprises of a top arm tee fitting 112 that is rotatably connected to a first 45 degree fitting 114. With regards to FIG. 5, a top inner arm 116 connects to fitting 114, and slidably engages in a telescopic fashion inside top outer arm 118. A first wire lock pin 120 passes through holes defined in both arms, locking them from sliding with each other. Top adjustable arm system 104 connects to base foundation 36 when top outer arm 118 connects to threaded 45 degree fitting 122 that is revolvably connected to front threaded tee fitting 62.

With reference to FIG. 9, bottom adjustable arm system 106 comprises of a bottom arm tee fitting 124 that is rotatably connected vertical leg 102. A bottom inner arm 126 connects to fitting 124 on one end, and at the other end slidably engages in a telescopic fashion inside bottom outer arm 128. With regards to FIG. 5, a second wire lock pin 130 passes through holes defined in both arms, locking them from sliding with each other. Bottom adjustable arm system 106 connects to rear base member 74 when bottom outer arm 128 connects to side aft member 64 by male threaded 90 degree fitting 132 (connected to arm 128) revolvably connected to a female threaded 90 degree fitting 134 (connected to member 64).

With reference to FIGS. 6 and 9, a sliding base system 108 comprises of a top sliding cross fitting 136 that slidably engages with arm 68. A bottom-sliding tee fitting 138 connects to the cross fitting 136 and slidably engages with bottom arm 140. With reference to FIG. 6, both arms 138 and 140 are connected to each other when first end cap 90-degree fitting 142 (connected to arm 138) connects to second end cap 90-degree fitting 144 (connected to arm 140). With reference to FIG. 10, the bottom arm 140 is connected to outer guide system 54 as it is connected to outer guide tee fitting 146, which slidably engages with outer rail 148. An outer front and rear stop 150A and B slidably engages over rail 148, providing sufficient clearance for rail fitting 146 to travel freely over outer rail 148 without watercraft outside side wall 152 rubbing or interfering with this travel.

Figure 11:
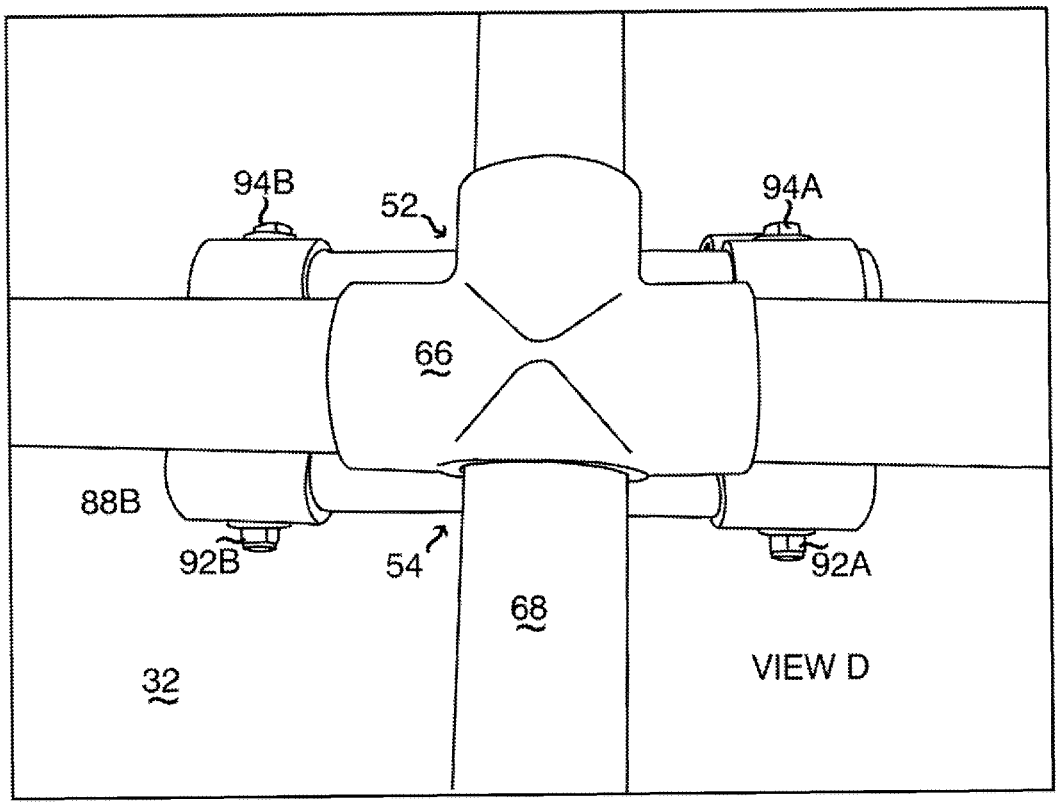
FIG. 11 is a close-up of View D callout in FIG. 5

The previously mentioned bolts and nuts for Inner guide system 52 doubles up as the same attachment system for the outer guide system 54. Thus, both front and rear bolts 92 A and B passes through holes defined by outer front and rear stops 150A and B, by outer rail 148, and by watercraft side walls 90 and 152. The bolts are then fastened down with front and rear nut 94A and B. With reference to FIG. 11, this fastens both inner and outer guide system onto watercraft 32 using a commonly shared bolt and nut system.

Figure 12:
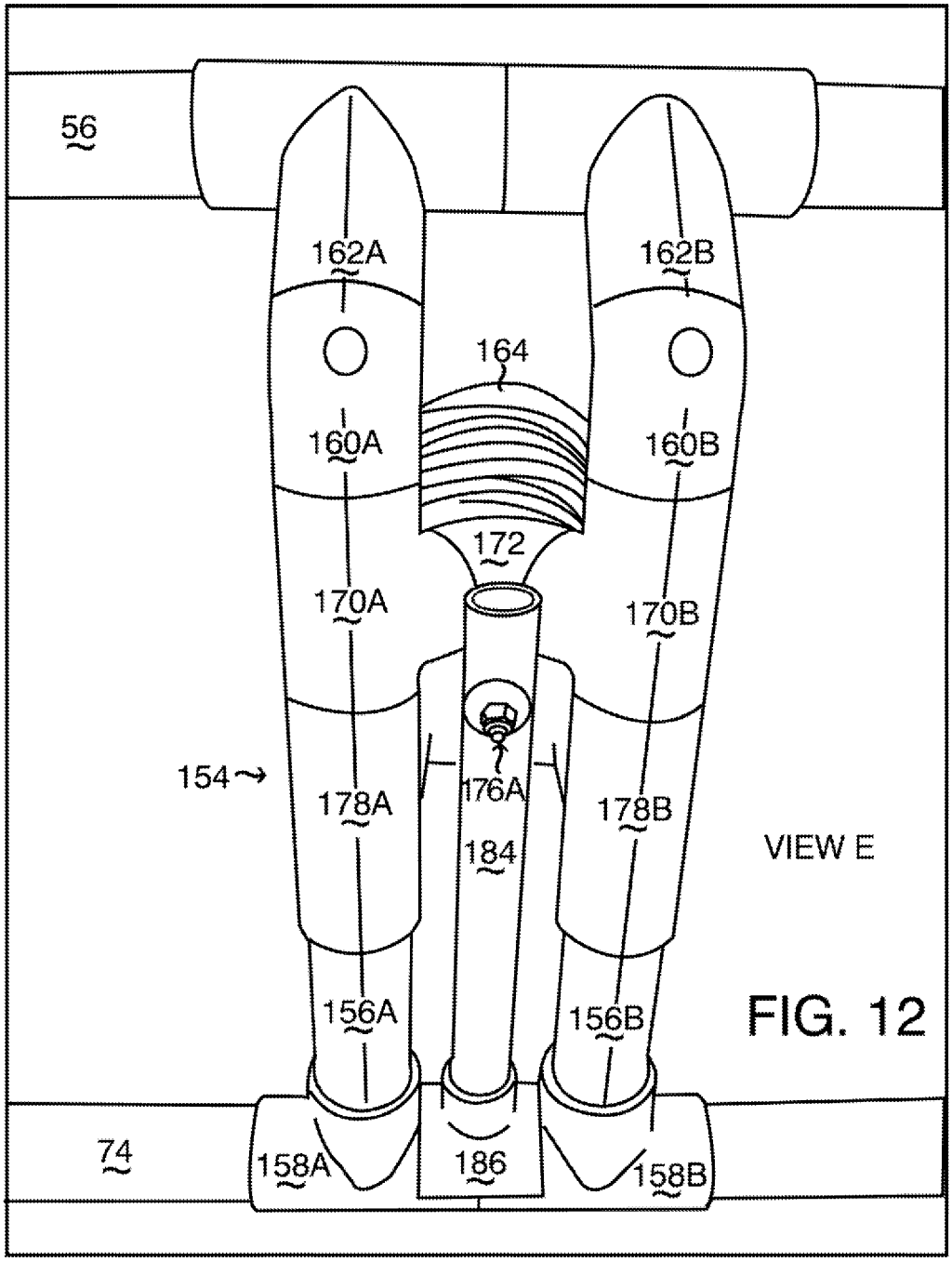
FIG. 12 is a close-up of View E callout in FIG. 13

With reference to FIG. 12, rowing rig 30 is further strengthened by a dual brace system 154 that connects front base member 56 to rear base member 74. The dual rail system 154 comprises of a right brace member 156A connected to rear base member 74 by right bottom tee fitting 158A. On the opposite end, the member 156 A connects to right second 45 degree fitting 160A, which connects to right top tee fitting 162A that connects to front base member 56. The left brace 156B is a duplicate of and adjacent to this right brace setup. Hence all teaching that describes the right side applies for the left side. The left brace thus comprises of left brace member 156B connected to rear base member 74 by left bottom tee fitting 158B. On the opposite end, the member connects to left 45 degree fitting 160B, which connects to left top tee fitting 162B that connects to front base member 56.

Figure 13:
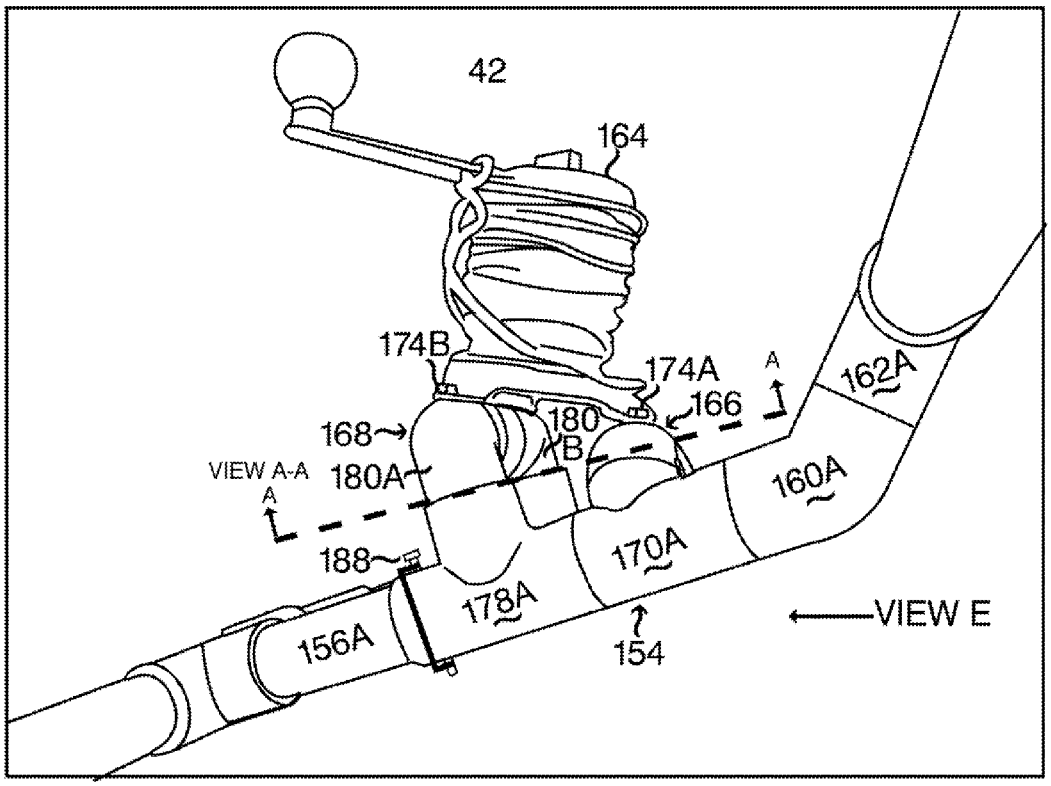
FIG. 13 is a side view close-up of Anchor system
Figure 14:
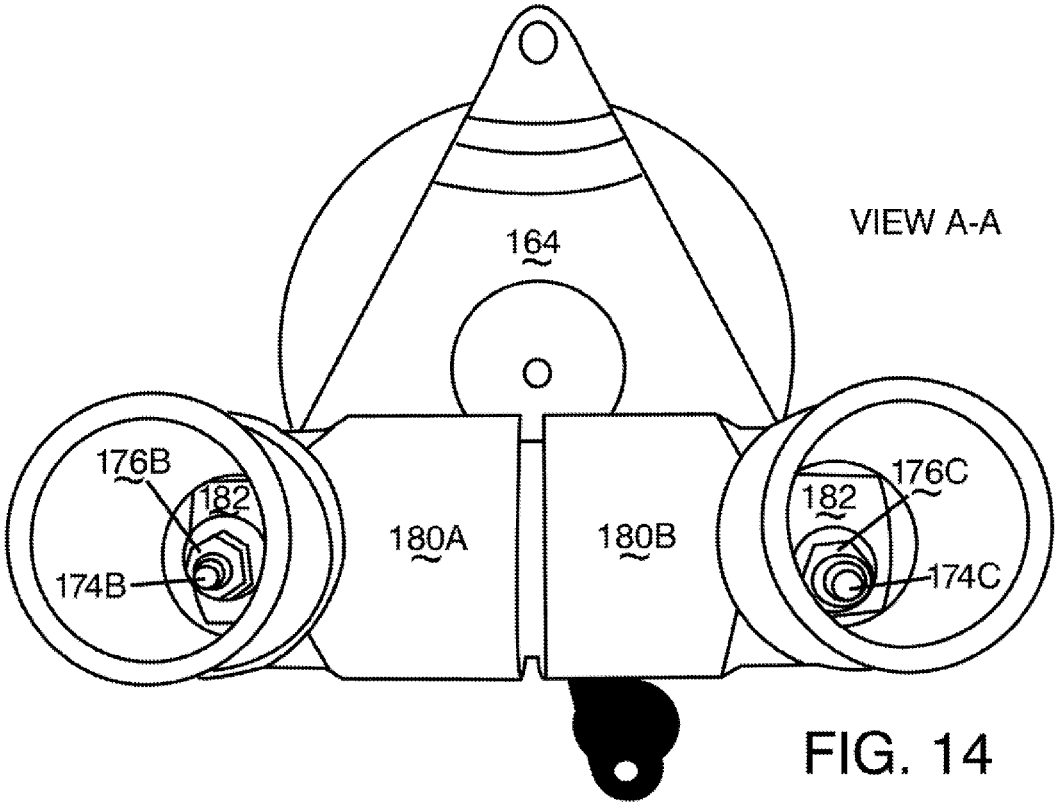
FIG. 14 is a cut section A-A through anchor system in FIG. 13

With reference to FIG. 13, anchor winch system consists of an anchor winch 164 is attached to the dual brace system 154 by attaching the winch to top bridge mount 166 and to bottom bridge mount 168. With reference to FIG. 12, the top bridge mount 166 comprise of a right and left top bridge mount tee fitting, 170 A and B, slidably connected to right and left brace members 156 A and B respectively. Both fittings are connected to each other by top center bridge 90-degree fitting 172. With reference to FIG. 13, the top attachment for anchor winch 164 is secured by a first anchor bolt 174A passing through holes defined by center bridge 90 degree fitting 172, and is secured by first anchor nut 176A (see FIG. 12). With reference to FIG. 12, the bottom bridge mount comprise of a right and left bottom bridge mount tee fitting, 178 A and B, slidably connected to right and left brace members 156 A and B respectively. With respect to FIGS. 13 and 14, both fittings 178 A and B are connected to each other by being connected to a union of a right and left bottom center bridge 90-degree fitting 180A and B connected to each other. With respect to FIG. 14, the bottom two attachments for anchor winch 164 are secured by a second and third anchor bolts 174B and C that passes through holes defined by both bottom center bridge 90-degree fittings 180 A and B. The bolts pass through another set of holes defined by a bottom stress carrying member 182 that is trapped in place when second and third anchor nuts 176 B and C fasten onto their respective bolts.

The entire anchor winch 164 can be adjusted up and down the dual brace system 154 so as to provide sufficient clearance for rowing hands during the entire rowing stroke. This keeps the anchor winch close to the rower so it is within easy and fast access when needed, yet out of the way from impeding with the needed hand clearances during rowing. With respect to FIG. 12, it may be necessary to lock the anchor winch along the dual brace system using a anchor fixing member 184 connected to rear base member 74 with anchor fixing tee 186. The top anchor winch attachment bolt 174A passes through holes defined by anchor fixing member 184, and is secured by first anchor nut 176A. An alternative is to use a third wire lock pin 188 passing through holes defined by right brace member 156A and right bottom bridge mount tee fitting 178A.

Foot Rest, FIGS. 15-20

This right side teaching is repeated for the left side of the figures, and vice versa, as the embodiment is symmetrically identical on both sides where applicable, with the part callout having an 'A' sub part name for the Right side, and 'B' for the Left side for teaching purposes. Whenever there is no subpart name, it is assumed the right side for left side teaching and vice versa is still preserved.

Figure 15:
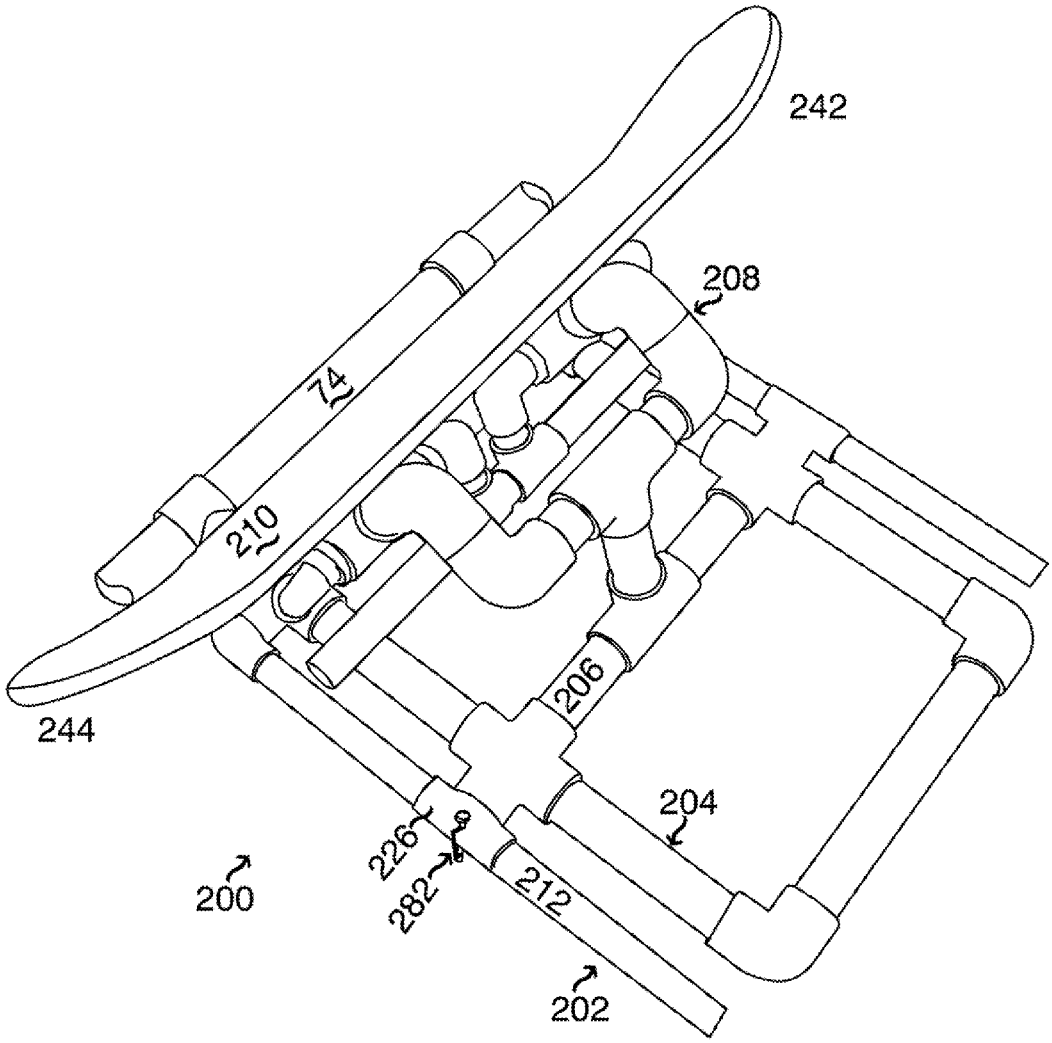
FIG. 15 is a isometric view of the Foot Rest system

With reference to FIG. 15, the foot rest system 200 is connected to the rowing rig 30 by connecting to rear base member 74. The foot rest system 200 comprises mainly of an FR outside rail system 202, FR inside rail system 204, and FR static cross member 205 (better shown in FIG. 16), an FR moving cross member 206, a FR recline system 208, and a foot board 210.

Right side 244 of the Foot Rest 200 contains the same elements, functionality, and operations as Left side 242 of Foot Rest. To avoid redundancy, all descriptions for the Right side equally applies to the Left side, and vice versa, except for elements not reflected around the center line.

Figure 16:
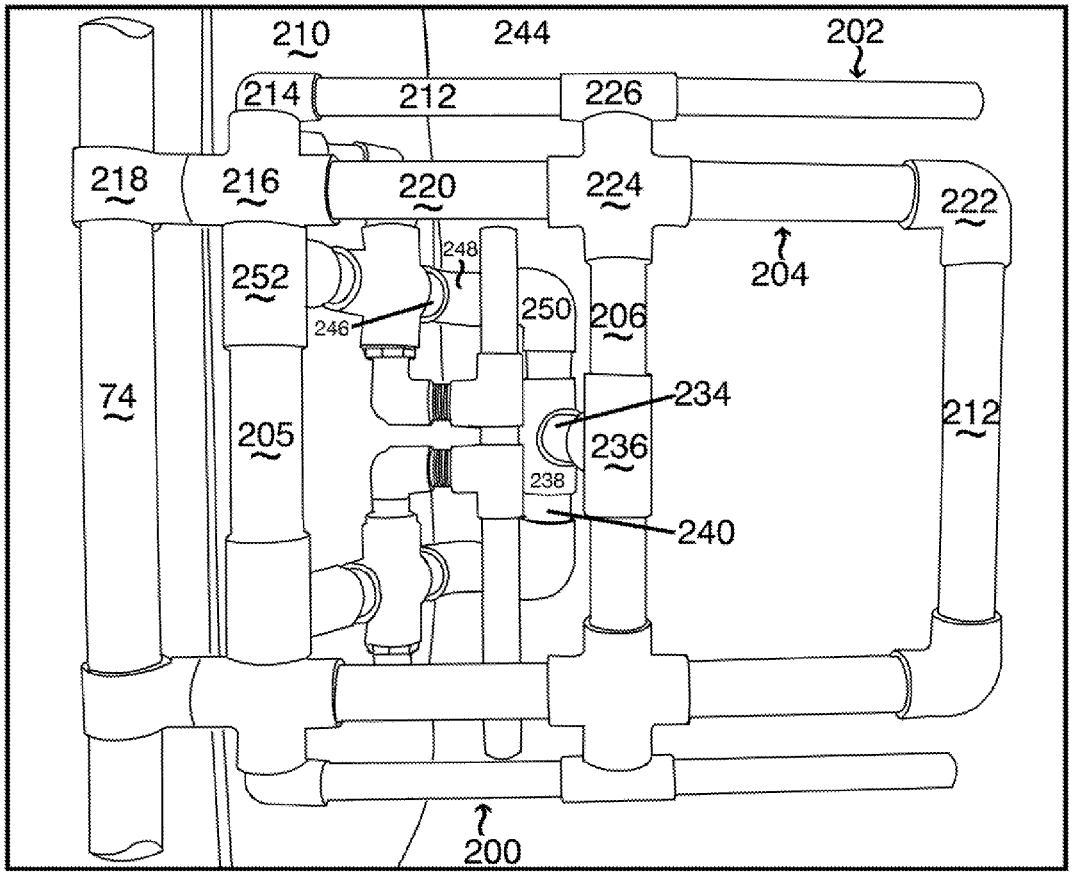
FIG. 16 is a bottom view of Foot rest system

With reference to FIG. 16, FR outside rail system 202 comprise of FR outside rail member 212 connected to FR first 90 degree fitting 214. Fitting 214 is connected to FR first cross fitting 216 that slidably engages with FR side member 220. FR Side member 220 connects to FR Base fitting 218 that revolvably connects to rear base member 74, completing the FR outside rail system 202 connection to Rowing rig 30.

FR inside rail system 204 comprise of a FR side member 220 that connects to FR base fitting 218 on one end, with the other end connecting to FR Cross member 90 degree fitting 222.

FR moving cross member 206 connects both inner 204 and outside 202 rail system by having 1) having one end of member 206 connect to FR second cross fitting 224 that slidably engages with side member 220, and 2) fitting 224 connected to FR outside rail 90 degree fitting 226 that slidably engages with outside rail 212.

With respect to FIG. 17*a*, The FR recline system 208 comprises of a Board support system 228, a Bracing system 230, and a Kick out system 232.

The Bracing system 230 comprise of a bracing member 234 connected to FR moving cross member 206 by having one end connected to first bracing fitting 236 that is revolvably connected to cross member 206. With respect to FIG. 16, the other end of bracing member 234 is connected to second bracing fitting 238 that is revolvably connected to Bridge member 240. With respect to FIG. 18, bridge member connects the left side 242 of board support system 228 to right side board system 244.

With respect to FIG. 16 and FIG. 17A, the Board support system 228 comprise of Support member 246 connected to bridge member 240 by having one end connected to BS first 90 degree fitting 248. BS second 90 degree fitting 250 has one end connected to fitting 248 and the other end connected to bridge member 240. The support member 246 other end is connected to BS base fitting 252 that revolvably engages with FR static cross member 205(shown in FIG. 16). Fitting 252 is also revolvably engaged with fitting 216.

With respect to FIG. 19A, the Kick out system 232 consists of a KO Cross fitting 254 that slidably and revolvably engages with support member 246. A KO first 90 degree fitting 256 is revolvably connected to fitting 254. Board tee fitting 258 is revolvably connected to fitting 256 with first threaded member 260 connecting to both fittings 258 and 256. An anti tilt second 90 degree fitting 262 is revolvably connected to cross fitting 254. Anti tilt tee fitting 264 is revolvably connected to fitting 262 with second threaded member 266 connecting to both fittings.

The two sides 242 and 244 are further connected to each other with fittings 258 A and B slidably connected to first sliding member 268, and fittings 264 A and B slidably connecting to Second sliding member 270.

With reference to FIG. 19, foot board 210 is connected to first sliding member 268 by a 'C' shape attachment strap 280 that slidably and revolvably engages with member 268 and is fastened to foot board 210.

With reference to FIG. 15, FR first wirelock pin 282 is passed through holes featured in both fittings 226 and member 212. This locks the angle foot board 210 angle to the horizon.

With reference to FIG. 19, FR second wirelock pin 284 is passed through holes featured in both fittings 216 and member 220. This locks the Board support system 228, Bracing system 230, and Kick out system 232 from travelling fore and aft.

With reference to FIG. 20, Rowing 30 rig is further connected to watercraft 32 by gunwale connection 50, comprising of U bolt 190 passing over front base member 56, with both ends of bolt passing through a V housing 192 and held in place with wingnuts 194A and B. The housing 192 engages with front member 56 and with a corner defined by gunwale 300 and inside sidewall 90. This gunwale connection is needed to counteract the forces caused when the foot rest system 200 is under operation.

Operation: Rowing Rig: FIGS. 5 to 14

The following teaching pertains to the right side 48 of FIGS. 5 and 6. This teaching is duplicated to operate the other (left) side 46 where applicable.

With reference to FIG. 9, the oarlock 40 is adjustable in the Z direction with the simple snap removal of vertical leg shims 111A and B, moving oarlock 40 to a new vertical location, and then snapping shims back onto vertical leg 102 in a way that traps the oarlock in the Z-axis while under rowing stress. When designed right, there is no oarlock fitting 100 vertical movement as the stack up dimension combining both these shims 111A&B and oarlock fitting 100 is nearly the same as the portion of the leg 102 exposed between fitting 112 and bottom arm tee fitting 124. This allows oarlock fitting 100 to assume any vertical position along the exposed longitudinal portion of leg 102, but only in the increments as wide of the width of these shims 111A&B. For the first adjustment that secures oarlock fitting 100 in place of shim 111A, simply snap remove shim 111A from leg 102, raise fitting 100 into it's former place, and snap back shim 111A beneath fitting 100. For the second adjustment that further raises the oarlock 40 to next higher position, snap out shim 111B from leg 102, raise fitting 100 into its former place, and snap back shim 111B onto leg 102 just beneath fitting 100. Although 3 possible Z-axis positions are shown in this present embodiment, a greater combinations and higher degree of fine tuning is possible from decreasing the width of the vertical leg shims 111A&B, along with increasing the amount of shims to completely cover the exposed portion of leg 102. Also, a greater range of Z-axis adjustment is achieved by increasing the distance between fitting 112 and bottom arm tee fitting 124. As long as the net dimensional stack of all shims 111 and fittings 100 is nearly the same as the exposed portion of vertical leg 102, there should not be excessive play or slop in oarlock fitting 100 in the Z-axis.

With reference to FIG. 5, oarlock 40 is adjustable in the Y-axis by simply telescoping the top and bottom adjustable arm systems 104 and 106 respectively. To telescope the both arm systems, first and second wirelock pins 120 and 130 are removed, and top sliding cross fitting 136 is move in a sliding manner along arm 68 until the desired Y-axis position. Wirelock pins 120 and 130 are then reinserted into both arm system by passing through holes features in both outer and inner arms of both system and wirelocked so that pins do not fall out. A greater degree of fine-tuning in this direction can be achieved by adding more holes in both outer and inner arms that are more closely spaced apart. Or in the alternative, a compression nut—a known art—can be used that provides infinite adjustments without relying on holes, holes that could weaken the members when featured excessively.

With reference to FIG. 7, oarlock 40 is adjustable in the X-axis by adjusting shims 96A, B, and C, and rail fitting 84 arrangement on inner guide system 52. For the first adjustment that adjust oarlock 40 rearward from currently shown in FIG. 7, simply snap remove shim 96B from inner rail 86, move fitting 84 rearward into shim's former place, and snap back shim 96B in front of fitting 84. However, if the adjustment is in the forward direction, for the second adjustment starting with original position shown in FIG. 7, snap out shim 96A from rail 86, move forward fitting 84 into shim's 96A former place, and snap back shim 96A behind fitting 84. And for even more forward adjustment for a third adjustment, snap out shim 96C, move forward fitting 84 into shim's 96C former place, and snap back shim 96C behind fitting 84. Although 3 possible X-axis positions are shown in this present embodiment, there exist even greater combinations and higher degree of fine-tuning. This increase can be achieved through shortening the width of the shims 96 A, B, and C, increasing the amount of shims to make up for this width decrease, and/or increasing the exposed length of inner rail 86 between inner stops 88A and B. These changes will still work so long the net dimensional stack of all shims 96 and fitting 84 is nearly the same as the exposed inner rail 86 portion; a criterion that traps the fitting 84 in the X-axis without excessive play or slop.

With reference to FIG. 10, the outer guide system 54 does not have any shims. Rather it does not need as the outer guide tee fitting 146 goes for the ride whenever fitting 84 from the inner guide system 52 is moved up and down in the X axis.

This is because both fittings 84 and 146 are connected by together to act as one unit in the X direction by series of members and fittings described earlier. Thus, and in reference to FIGS. 10 and 11, the outer guide system 54 passively moves together with the inner guide system so as to continuously provide a compression support for Vertical member 102 under Z axis loads.

With reference to FIG. 12, the entire anchor winch 164 can be adjusted up and down the dual brace system 154 so as to provide sufficient clearance for rowing hands during the entire rowing stroke but still close enough to operate winch ergonomically. This keeps the anchor winch close to the rower so it is within easy and fast access when needed, yet out of the way without impeding the needed hand clearances during rowing. Anchor winch 164 is adjusted and locked along the dual brace system using a anchor fixing member 184 connected to rear base member 74 with anchor fixing tee 186. This member 184 may have a plurality of holes that allows the top anchor winch attachment bolt 174A to pass holes through to be secured by first anchor nut 176A. With reference to FIG. 13, locking anchor winch 164 in differing locations is accomplished by using a third wire lock pin 188 passing through a plurality of holes are defined by left brace member 156A so as to match up with a hole defined by left bottom bridge mount tee fitting 178A before pin 188 passes through and wirelocks to itself so it won't back out from holes.

Operation: Foot Rest: FIGS. 15 to 20

With reference to FIG. 19A, the fore and aft location of foot board 210 is adjustable by removing wirelock pin 284, and sliding fitting 216 fore and aft until a desired and new location on member 220 that has both fitting and member holes lined up. Lock down this new foot board 210 location by passing wirelock pin 284 through this set of holes.

With reference to FIG. 15, the angle of the foot board is adjustable by removing wirelock pin 282 and sliding fitting 226 fore and aft until a desired and new location on member 212 that has both fitting and member holes lined up. Lock down this new foot board 210 angle by passing wirelock pin 282 through this set of holes.

With Reference to FIGS. 17A and B, a sequence of 5 deployed positions are shown to show the full extent the foot board 210 is able to sequence from the position show in FIG. 15 to a raised but angled position 286, a flat position 288, a reverse angle but forward position 290, and a reverse angle but rearward position 292 (shown in FIG. 17B).

With Reference to FIG. 17A, a raised but angled position 286 is quickly achieved by raising fitting 254 and snapping in second set of shims 294 that is identical to shims 96A, B, and C, and trapped in the same manner as described in the operation of trapping fitting 84 without movement on inner rail 86.

With Reference to FIG. 17A, a flat top position 288 is achieved similarly as with position 286 using shims 294 in a combination that raises and traps fitting 254 high enough so that foot board 210 is resting on the top of fitting 248 in a flat manner. Additionally, member 268 swings out around fitting 254 to first swing out position 296.

With Reference to FIG. 17A, a reverse angle but forward position 290 is achieved similarly as with position 288 using shims 294 in a combination that raises and traps fitting 254 even more high enough so that foot board 210 is resting on the top of BOTH fittings 248 and 250 and in a reverse-angle-but-forward manner. Additionally, member 268 swings out and rotates further clockwise around fitting 254 to a second swing out position 298.

With Reference to FIG. 17B, a reverse angle but rearward position 292 is achieved starting with the reverse angle but forward position 290 shown in FIG. 17A. Starting with this 290 position, lower member 270 until it touches member 246, turn fitting 254 by 90 degrees. With additional reference to FIG. 19A (position 290) and during the procedure of creating position 292 from 290, the Kick out system 232 will automatically and passively remove any binding, allowing fittings 264A and B to revolve around members 266 A and B respectively, and fittings 258 A and B to revolve around members 260 A and B respectively. Additionally, kick out system 232 allows member 270 to slide in fittings 264 A and B, and member 268 to slide in fittings 258 A and B and in 'C' shape attachment strap 280. This turning of fittings 254A and B by 90 degrees then moves the foot board 210 rearward to this new rearward but reverse angle position 292, better seen in FIG. 17B.

Because the foot rest 200 is a connected part to the rear base member 74, any fore and aft adjustment in the Rowing Rig 30 relative to the watercraft 32 will also cause similar fore and aft changes to the foot rest system 200 position relative to watercraft 32. This foot rest adjustment still preserves the foot board's 210 angle or position relative to rear base member 74. This preservation may be beneficial to certain setup changes where changes to the distance between 1) foot board 210 and row seat 34, and between 2) rear base member 74 to row seat 34, are one the same.

For all foot board positions other than position 292, Kick out system 232 is positioned in the manner where the longitudinal axis of threaded members 266A and B are about perpendicular to the longitudinal axis of support member 246. This is to ensure that an uneven or unbalance force applied to board 210 will not result in tipping the board from having the side with the lesser force to lift away from the board support system 228.

DESCRIPTION

Alternative Embodiment FIG. 21-24

Rowing Rig: Alternative Embodiment of Rowing Rig 200 Attachment to Watercraft 32:

With reference to FIG. 7, shims 96 A, B, and C can be eliminated, freeing rowing rig 30 to travel freely along inner and outer guide 52 and 54 respectively. A conjunction use with foot rest 200 modified with a hold down foot strap (not shown) allows the rower to row not by pulling on the oars, but rather moving rowing rig 30 fore and aft relative to watercraft 32 while holding onto the oar by it's handle. The added benefit with this moving arrangement is the rower can now use his larger and greater stamina leg muscles as the source for his propulsion, allowing him to go further longer.

However, this would require a new gunwale attachment arrangement between front base member 56 connection to gunwale 300 so as to permit this free movement while counteracting against bracing foot forces against footrest 200. With reference to FIG. 21, I contemplate this new attachment to comprise of a bi-wheel arrangement whereby both wheels spin independent of each other, housed as one unit on a common housing 304, with top wheel 302A riding along front member 56 longitudinally, and with bottom wheel 302B riding at about a 45 degree angle along the inner lip edge defined by gunwale 300 and inside sidewall 90. The unit is connected to on and about fitting 60 in a spring loaded way using a spring 306 attached to housing 304 using an eyebolt 308.

Additionally, it may also require a new connection between 1) fitting 84 slidably connected to guide 86, and 2) fitting 146 slidably connected to guide 148. As shown in FIG. 22 as an example using the outside guide system 54 (but also applicable for inner guide system 52), a contemplated alternative connection is to replace fitting 84 and 146 with yoke carrying a center bearing wheel 310 riding at the bottom of a now C shape guides 312 (as seen in cut section) achieved by cutting exposed portion of rails 86 and 148 longitudinally in half.

Foot Rest Alternative Embodiment to Bridge Member 240 Connection to BS First 90 Degree Fitting 248.

With reference to FIGS. 18 and 23, bridge member 240 can connect directly to BS first 90 degree fittings 248A and B, eliminating the need for BS second 90 degree fittings 250A and B. This alternative embodiment simply requires fittings 248A and B to rotate 90 degrees towards the center of the foot rest 200, bracing member 234 to be elongated in length until both ends of member 240 fit and connect into fittings 248A and B.

Hence the need to kick out system 232 is even more important with this alternative embodiment in order for the footboard 210—now in reverse angle but rearward position 292—to be supported in a robust way with the front edge of the foot board 200 touching down on fitting 248.

Foot Rest: Addition of Self Centering Feature to Keep Foot Board Centered.

With reference to FIG. 24, a self centering feature 318 may be attached to the foot board 210 to keep foot board centered during operation. The feature 318 comprise of a right and left armature 320 A and B respectively. Both armatures are connected together by armature bridge 330. The teachings for right armature is identical to the left armature and vice versa, requiring a teaching for the right side only to avoid redundancy.

Right armature 320A comprise of a SC tee fitting 322A connected to foot board 210, with fitting tee end connected to SC 45 degree fitting 324A. A SC side member 326A connects to the fitting 324A on one end, and to a SC 90 degree fitting 328A on the other end. Bridge 330 connects to fitting 328A.

With reference to FIG. 24, fitting 322A and B slidably engages with sliding member 268 whose previous connections are described above. With reference to FIG. 19B, the feature 318 fits inside the U shape opening defined by support members 246A and B, member 205. The feature 318 keeps foot board 210 centered by having members 326A and B staying inside this U shape opening while cycling between all positions, at the same time without interfering the operations of the kick out system 232.

CONCLUSIONS, RAMIFICATIONS, AND SCOPE FOR ROWING RIG

From the description above, a number of advantages of some embodiments of my deployable device become evident:

1. The rowing rig 30 solves the ability to adjust an oarlock in the X, Y, Z axis in an independent manner for varying rower builds. This is accomplished through the use of adjustable but locking fittings and members to adjust oarlock 40 in space 3 dimensionally.
2. The rowing rig 30 solves the ability to provide meaningful adjustment range within each axis, having telescopic and locking members in the Y axis, having oar lock fitting 100 sliding along member 102 for the Z axis that is further locked in place using C shape shims 111A and B, and the entire rowing rig 30 removably attached to watercraft 32 in the X axis using C shape shims 96 A, B, and C.
3. The rowing rig 30 solves the ability to operate varying oar lengths ergonomically, having telescopic and locking members in the Y axis, having oar lock fitting 100 sliding along member 102 for the Z axis that is further locked in place using C shape shims 111A and B, and the entire rowing rig 30 removably attached to watercraft 32 in the X axis using C shape shims 96 A, B, and C.
4. The rowing rig 30 solves the ability to perform such adjustments without any tools or high need for skill and training. This is accomplished by having 1) wire lock pins 120 and 130 passing through holes features in Y axis members 116/118 and 126/128 respectively, 2) having oar lock fitting 100 sliding along member 102 for the Z axis that is further locked in place using C shape shims 111A and B, and 3) the entire rowing rig 30 removably attached to watercraft 32 in the X axis using C shape shims 96 A, B, and C.
5. The rowing rig 30 solves the ability to perform such adjustment without incurring any time consuming downtime such as mooring, using the above cited pins 120 and 130, shims 111A and B, and shims 96 A, B, and C. Also all adjustment simply require a sliding between parts, an act that is easily performed while in the watercraft 32.
6. The rowing rig 30 solves the ability to recall prior locations in a highly reproducible and repeatable way. This is accomplished by using the above cited pins 120 and 130 into corresponding holes cited above, shims 111A and B and shims 96 A, B, and C onto corresponding guide members 102 and 86 that only have a fixed combinations of shim arrangement without sacrificing a wide span of adjustment.
7. The rowing rig 30 solves the ability to fit the art into a canoe with fixed seats and to function with the fixed seat. This is solved with rowing rig designed compact enough as a drop in unit into the watercraft 32 without requiring the removal of seats 34, but rather can be used in conjunction with seat 34. Also rig 30 can be placed in desired distance from rowing seat 34 before the guide bolts 92 A and B secure the rig 30 to water craft 32.
8. The rowing rig 30 solves the ability to have adjustable footrest independent of any oarlock adjustments, with foot rest 200 having independent adjustment in X, Z, and Angle direction described in Operations teaching above.
9. The rowing rig 30 solves the ability to not deform a plastic canoe under operation, as it converts the bending stresses on outside sidewall 152 created from oar stresses to a compression stress transmitted along bottom arm 140, spreading this compression stress onto a large but sturdier outer guide system 54. The rowing rig 200 cage-like design further resists any deformation that is left over from outer guide system 54, resisting this compression stress even further, avoiding deformation.
10. The rowing rig 30 solves the ability to incorporate additional systems that controls the safety and maneuverability of the canoe (such as an Anchor winch 164). This is accomplished with anchor winch 164 mounted onto the dual brace system 154 so that this portion of the structural part of the rig 30 is strong enough to resist the anchor winch forces when under use.
11. The rowing rig 30 solves and the ability to have these additional systems accessible and within ergonomic reach from a seated rowing position without impeding other functions such as rowing. This is accomplished by having winch 42 right in front of the rower but out of the way to function the oars.
12. Other advantages of one or more aspects will be apparent from a consideration of the drawings and ensuing description.

Ramifications:

Although the embodiments show connections (such as 90 degree fitting 60 connecting to fitting 62) connecting non moving members together, these members can be coupled together by other methods such as welding, epoxy gluing, wrapping, etc. This eliminates the connections themselves, reducing the assembly complexity (less elements), reducing the weight, as well as cost. Additionally, a connection can be made integral to a member communicating with it in a static way when coupled together. An example of integration is injection molding the 90-degree fitting 60 onto front base member 56. Additionally, the fitting can be wholly eliminated if a member can be bent in the same shape as outlined by an assembly of members and connections, such as making L shape configuration defined by fitting 60 and member 56.

The front base member may be further secured onto watercraft 32 by providing an attaching front base member 56 onto the gunwale 300 using a gunwale connection 50 as show in FIG. 20. This connection is loosened up before rig 30 can move fore and aft before being locked back down in place. This securing member 56 to gunwale 50 is even more important when rowing rig 30 is operating with foot rest 200 attached to it as show in FIG. 5. This connection 50 counteracts any fore and aft forces applies to foot rest 200.

Fitting 114 connection to fitting 112 can be made rotatable in cases where more bind free function is needed when sliding fitting 136 along arm 68. An annular groove in fitting 114 locking into an annular locking ring in fitting 112, as well as a reverse role arrangement, can accomplish this rotatable connection.

Additionally, screws may be added to further secure coupled parts that are non-moving when coupled together.

Additionally, front base member 56 can be a 'U', 'V', or other similarly shaped support, sometimes with a dip inside the watercraft 32. This change allows better stowage further below the horizontal surface defined from gunwale to gunwale or sometimes improved leg clearances to the foot rest 44, especially in the reverse angle positions 290 and 292.

Additionally, the rowing rig 30 can be installed backwards with the rower facing the rear of the watercraft 32.

Additionally, an wire and locking pulley system—a known art in ships—may be used instead of the shims 111A and B; shims 96 A, B, and C; and wirelock pins 120 and 130. This would be a more convenient—although more costly design-to quickly adjust and then lock down oar 40 position in 3 axis.

Additionally, the use of shims 111A and B; shims 96 A, B, and C; and wirelock pins 120 and 130, can be completely eliminated if a servo motor or a like changes the adjustments in 3 axis. And that this proposed device either has a locking means, or is strong enough to keep these adjustments fixed under oar stress.

While the above description contains many specificities, these should not be construed as limitations on the scope of any embodiments, but as illustrations of various embodiments thereof. Many other ramifications and variations are possible with the teachings of the various embodiments. For example, the rowing rig 30 can be mounted on any body of interest, for instance, to a tractor that has a suspended device (314) such as a pipe that has nozzles sprays along it in lieu of oar lock 40 to dispense chemicals, adjusting laterally for differing separation distances between rows of plants. Another example would be oar lock 40 might be substituted with skis or a means to stabilize on snow, ice, or mud, or any other environment. Another example may be even replacing oarlock 40 with weights to reduce watercraft tipping and to slow it down in a current. Another example would be providing means to extend a deck that supports weight, such as attaching a waterproof flexible material between the fitting and members in rig 30. Another example would be providing a means to cover a boat during storage or even providing boat occupants a means to protect them from the environment. This requires connecting the corners of a collapsible waterproof material to the raised or securable features in rig 30.

Accordingly, the scope should be determined not by the embodiments illustrated, but by the appended claims and their legal equivalents.

The invention claimed is:

1. A rowing rig apparatus comprising:

an oarlock connecting to a vertical leg, the vertical leg having a first vertical end and a second vertical end, the vertical leg extending in a vertical direction, the oarlock having an oarlock fitting to slide along the vertical leg and to removably attach to the vertical leg in at least a first position or a second position, the second position being at a different distance from the first vertical end of the vertical leg than the first position;

a first horizontal arm having a first horizontal end and a second horizontal end, the first horizontal arm extending in a first horizontal direction, the vertical leg having a sliding base system to slide along the first horizontal arm and to removably attach to the first horizontal arm in at least a third position and fourth position, the third position being at a different distance from the first horizontal end than the fourth position;

a vehicle connection member connecting to the first horizontal arm or the vertical leg, the vehicle connection member connecting to a first side of a vehicle, translating along the first side of the vehicle, and removably attaching to the first side of the vehicle in at least a fifth position or a sixth position, wherein the oarlock moves in vertical, lateral, and longitudinal directions by sliding the oarlock along the vertical leg, sliding the vertical leg along the first horizontal arm, and translating the vehicle connection member alone the first side of the vehicle, and wherein the vertical, lateral, and longitudinal directions are perpendicular to one another; and an anchor winch connected to the vehicle connection member, the anchor winch applying an additional force to the vehicle connection member without damaging the vehicle connection member.

2. The apparatus of claim 1, wherein the vehicle is a watercraft.

3. The apparatus of claim 1, wherein at least one removable shim snaps on to and snaps off of the vertical leg.

4. The apparatus of claim 3, wherein the oarlock is removably attached to the vertical leg in at least one of the first position or the second position via the at least one removable shim.

5. The apparatus of claim 3, wherein the vehicle connection member is removably attached to the first side of the vehicle in at least one of a fifth position or a sixth position via the at least one removable shim.

6. The apparatus of claim 5, wherein the at least one removable shim is adjustable by an operator of the vehicle while the vehicle is being operated.

7. The apparatus of claim 1, wherein a footrest system is removably attached to the first horizontal arm.

8. The apparatus of claim 1, wherein the vehicle connection member has sliding or rolling means to slide or roll along the first side of the vehicle.

9. The apparatus of claim 1, wherein the first side of the vehicle extends in a second horizontal direction, the second horizontal direction being normal to the first horizontal direction.

10. The apparatus of claim 1, further comprising:

a second horizontal arm lying parallel to the first horizontal arm and connecting to the vertical leg.

11. The apparatus of claim 10, wherein the second horizontal arm directs a force in the vertical direction or in at least one horizontal direction from the oarlock to the vehicle.

12. The apparatus of claim 1, further comprising:

at least one side arm lying parallel to the first side of the vehicle, the at least one side arm connecting to at least one of the first horizontal arm or the second horizontal arm.

13. The apparatus of claim 12, wherein the connection between the vertical leg and the at least one side arm is made by at least one adjustable arm having a first arm end and a second arm end, the first arm end is rotatably connected to the at least one side arm, the second arm end is rotatably connected to the vertical leg, the first arm end rotates around the longitudinal axis of or an axis normal to the longitudinal axis of the at least one side arm, and the second arm end rotates around the longitudinal axis of or an axis normal to the longitudinal axis of the vertical leg.

14. The apparatus of claim 12, wherein the at least one side arm directs a force in at least one horizontal direction from the oarlock to the vehicle.

15. The apparatus of claim 1, wherein the vehicle connection member connects to the first side of vehicle in a location proximate to a seat for an operator of the vehicle.

16. The apparatus of claim 15, wherein the location proximate to the seat for the operator of the vehicle is selected by the operator of the vehicle.

17. A rowing rig apparatus comprising:

an oarlock connected to a vertical leg, the vertical leg having a first vertical end and a second vertical end, the vertical leg extending in a vertical direction, the oarlock having an oarlock fitting to slide along the vertical leg and to removably attach to the vertical leg in at least a first position or a second position, the second position being at a different distance from the first vertical end of the vertical leg than the first position; and a first horizontal arm having, a first horizontal end and a second horizontal end, the first horizontal arm extending in a first horizontal direction, the vertical leg having a sliding base system to slide along, the first horizontal arm and to removably attach to the first horizontal arm in at least a third position and fourth position, the third position being at a different distance from the first horizontal end than the fourth position;

wherein the oarlock moves in vertical, lateral, and longitudinal directions by sliding the oarlock alone the vertical leg, sliding the vertical leg alone the first horizontal arm, and translating the horizontal arm along the first side of the vehicle, and wherein the vertical, lateral, and longitudinal directions are perpendicular to one another.

18. The apparatus of claim 17, further comprising a vehicle connection member connecting to the first horizontal arm or the vertical leg, the vehicle connection member connecting to a first side of a vehicle, translating along the first side of the vehicle, and removably attaching to the first side of the vehicle in at least a fifth position or a sixth position, wherein the oarlock further moves by translating the vehicle connection member along the first side of the vehicle.

19. The apparatus of claim 17 further comprising an anchor winch connected to the vehicle connection member, the anchor winch applying an additional force to the vehicle connection member without damaging the vehicle connection member.

20. A watercraft comprising:

a first apparatus at a left side of the watercraft, the first apparatus comprising:

a left oarlock connected to a left vertical leg, the left vertical leg having a first left vertical end and a second left vertical end, the left vertical leg extending in a vertical direction, the left oarlock having a left oarlock fitting to slide along the left vertical leg and to removably attach to the left vertical leg in at least a first left position or a second left position, the second left position being at a different distance from the first left vertical end of the left vertical leg than the first left position, a first left horizontal arm having a first left horizontal end and a second left horizontal end, the first left horizontal arm extending in a first horizontal direction, the left vertical leg having a left sliding base system to slide along the first left horizontal arm and to removably attach to the first left horizontal arm in at least a third left position and fourth left position, the third left position being at a different distance from the first left horizontal end than the fourth left position, and a left vehicle connection member connected to the first left horizontal arm or the left vertical leg, the left vehicle connection member being connected to the left side of the watercraft, the left vehicle connection member translating along the left side of the watercraft, and removably attaching to the left side of the watercraft in at least a fifth left position or a sixth left position, wherein the left oarlock moves in vertical lateral and longitudinal directions by sliding the left oarlock along the left vertical leg, sliding the left vertical leg along the first left horizontal arm, and translating the left vehicle connection member along the left side of the vehicle, and wherein the vertical, lateral, and longitudinal directions are perpendicular to one another;

a second apparatus at a right side of the watercraft, the second apparatus comprising:

a right oarlock connected to a right vertical leg, the right vertical leg having a first right vertical end and a second right vertical end, the right vertical leg extending in the vertical direction, the right oarlock having a right oarlock fitting to slide along the right vertical leg and to removably attach to the right vertical leg in at least a first right position or a second right position, the second right position being at a different distance from the first right vertical end of the right vertical leg than the first right position, a first right horizontal arm having a first right horizontal end and a second right horizontal end, the first right horizontal arm extending in the first horizontal direction, the right vertical leg having a right sliding base system to slide along the first right horizontal arm and to removably attach to the first right horizontal arm in at least a third right position and fourth right, position, the third right position being at a different distance from the first right horizontal end than the fourth right position, and a right vehicle connection member connected to the first right horizontal arm or the right vertical leg, the right vehicle connection member being connected to the right side of the watercraft, the right vehicle connection member translating along the right side of the watercraft, and removably attaching to the right side of the watercraft in at least a fifth right position or a sixth right position, wherein the right oarlock moves in the vertical, lateral, and longitudinal directions by sliding the right oarlock along the right vertical leg, sliding the right vertical leg along the first right horizontal arm, and translating the right vehicle connection member alone the right side of the vehicle; and an anchor winch connected to at least one vehicle connection member, the anchor winch applying an additional force to the at least one vehicle connection member without damaging the at least one vehicle connection member, the at least one vehicle connection member comprising at least one of the left vehicle connection member or the right vehicle connection member.

* * * * *

UNITED STATES PATENT AND TRADEMARK OFFICE

CERTIFICATE OF CORRECTION

PATENT NO. : 8,540,537 B1
APPLICATION NO. : 13/149385
DATED : September 24, 2013
INVENTOR(S) : Barnitus A. Wong It is certified that error appears in the above-identified patent and that said Letters Patent is hereby corrected as shown below:

a. Column 20, line 37, claim 1, replace the word 'alone' with -along-.

b. Column 21, line 44, claim 17, delete the punctuation "," between the words 'along' and 'the first horizontal'.

c. Column 23, line 4, claim 20, replace the word 'alone' with -along-.

Signed and Sealed this
Seventh Day of June, 2016

Michelle K. Lee

Michelle K. Lee
*Director of the United States Patent and Trademark Office*